US012642413B2

(12) United States Patent
Kim et al.

(10) Patent No.: US 12,642,413 B2
(45) Date of Patent: Jun. 2, 2026

(54) ROBOT CLEANER AND CONTROL METHOD THEREOF

(71) Applicant: SAMSUNG ELECTRONICS CO., LTD., Suwon-si (KR)

(72) Inventors: Sunghyun Kim, Suwon-si (KR); Elijah Kim, Suwon-si (KR); Juyeong Kim, Suwon-si (KR); Junwon Seo, Suwon-si (KR); Hongseok Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 462 days.

(21) Appl. No.: 18/200,151

(22) Filed: May 22, 2023

(65) Prior Publication Data

US 2024/0023783 A1 Jan. 25, 2024

Related U.S. Application Data

(63) Continuation of application No. PCT/KR2023/005479, filed on Apr. 21, 2023.

(30) Foreign Application Priority Data

Jul. 22, 2022 (KR) ..... 10-2022-0090890

(51) Int. Cl.
*A47L 11/40* (2006.01)
*A47L 11/282* (2006.01)

(52) U.S. Cl.
CPC ..... *A47L 11/4038* (2013.01); *A47L 11/282* (2013.01); *A47L 11/4011* (2013.01); *A47L 11/4069* (2013.01); *A47L 2201/04* (2013.01)

(58) Field of Classification Search
CPC .. A47L 11/4038; A47L 11/282; A47L 11/283; A47L 11/4011; A47L 11/4069; A47L 2201/04
See application file for complete search history.

(56) References Cited

U.S. PATENT DOCUMENTS 7,412,750 B2 8/2008 Oh
10,111,569 B2 10/2018 Yan
(Continued)

FOREIGN PATENT DOCUMENTS

CN 111557617 A 8/2020
CN 112428124 A 3/2021
(Continued)

OTHER PUBLICATIONS

CN111557617A(machine translation) (Year: 2020).*
(Continued)

*Primary Examiner* — Andrew A Horton
(74) *Attorney, Agent, or Firm* — STAAS & HALSEY LLP

(57) ABSTRACT

A robot cleaner includes a motor, a rotating-shaft member, and a rotation member coupled to the rotating-shaft member and including a cleaning member coupling configured to be detachably coupled to a plurality of cleaning members. The motor, rotating-shaft member, and the rotation member are configured so that the motor is drivable to rotate the rotating-shaft member and thereby cause the rotation member to move in a first direction or a second direction opposite to the first direction, along a longitudinal direction of the rotating-shaft member. In a case that the rotation member moves in the first direction with the cleaning member coupling detachably coupled to the plurality of cleaning members, at least one cleaning member of the plurality of cleaning members becomes detached, and is thereby released, from the cleaning member coupling.

18 Claims, 21 Drawing Sheets

(56) References Cited

U.S. PATENT DOCUMENTS

| | | | |
|---|---|---|---|
| 11,478,120 | B2 | 10/2022 | Jang et al. |
| 11,571,103 | B2 | 2/2023 | Zhang et al. |
| 11,918,160 | B2 | 3/2024 | Zhang et al. |
| 2005/0015913 | A1 | 1/2005 | Kim et al. |
| 2022/0047141 | A1 | 2/2022 | Xu et al. |
| 2022/0079406 | A1 | 3/2022 | Zhang et al. |

FOREIGN PATENT DOCUMENTS

| | | | |
|---|---|---|---|
| CN | 112932345 | A | 6/2021 |
| CN | 113520244 | | 10/2021 |
| CN | 214342156 | U | 10/2021 |
| CN | 114190849 | A | 3/2022 |
| JP | 6285498 | | 2/2018 |
| JP | 2020-99666 | | 7/2020 |
| KP | 10-2005-0012047 | | 1/2005 |
| KR | 1998-063826 | | 11/1998 |
| KR | 10-0667875 | | 1/2007 |
| KR | 10-1233027 | | 2/2013 |
| KR | 10-2020-0119400 | | 10/2020 |
| KR | 10-2021-0105907 | | 8/2021 |
| KR | 10-2021-0108959 | | 9/2021 |
| KR | 10-2022-0016627 | | 2/2022 |
| KR | 10-2525001 | | 4/2023 |
| WO | WO 2019/031798 | A1 | 2/2019 |

OTHER PUBLICATIONS

International Search Report, PCT/ISA/210, issued on Jul. 18, 2023, in International Patent Application No. PCT/KR2023/005479 filed on Apr. 21, 2023.

Written Opinion, PCT/ISA/237, issued on Jul. 18, 2023, in International Patent Application No. PCT/KR2023/005479 filed on Apr. 21, 2023.

European Search Report dated Jul. 29, 2025, in counterpart European Application No. 23 84 3129.

* cited by examiner

ROBOT CLEANER AND CONTROL METHOD THEREOF

CROSS-REFERENCE TO RELATED APPLICATIONS

This application is a continuation application of International Application No. PCT/KR2023/005479 designating the United States, filed on Apr. 21, 2023, in the Korean Intellectual Property Receiving Office, which claims priority from Korean Patent Application No. 10-2022-0090890, filed on Jul. 22, 2022, in the Korean Intellectual Property Office, the disclosures of which are hereby incorporated by reference herein in their entireties.

BACKGROUND

1. Field

Various embodiments of the disclosure relate to a robot cleaner and its control method.

2. Description of Related Art

A robot cleaner is a device for automatically cleaning a certain cleaning space while travelling throughout the cleaning space without any user's manipulation. In general, a robot cleaner can perform the operation of inhaling foreign substances such as dust accumulated on a bottom surface (e.g., a floor surface) to be cleaned or wiping foreign substances such as dirt attached to the surface to be cleaned with a cleaning cloth (or a rag). Amongst these robot cleaners, a type of robot cleaner is used in which the cleaning cloth (or rag) is attached to one end and the cleaning cloth is rotated to wipe out foreign substances attached to the surface to be cleaned.

Meanwhile, as cleaning progresses, the cleaning cloth attached to the robot cleaner gets contaminated, and thus, its user has to replace the contaminated cleaning cloth attached to the robot cleaner with a new cleaning cloth so as to continue an effective cleaning.

SUMMARY

Various embodiments of the present disclosure enables automatic replacement of the contaminated cleaning cloth, by using a rotation member coupled to a plurality of cleaning cloths and capable of moving up and down according to a rotation direction.

A robot cleaner according to an embodiment of the disclosure comprises a motor, a rotating-shaft member, and a rotation member coupled to the rotating-shaft member and including a cleaning member coupling configured to be detachably coupled to a plurality of cleaning members. The motor, the rotating-shaft member, and the rotation member are configured so that the motor is drivable to rotate the rotating-shaft member and thereby cause the rotation member to move in a first direction or a second direction opposite to the first direction, along a longitudinal direction of the rotating-shaft member. In a case that the rotation member moves in the first direction with the cleaning member coupling detachably coupled to the plurality of cleaning members, at least one cleaning member of the plurality of cleaning members becomes detached, and is thereby released, from the cleaning member coupling.

According to an embodiment, as the rotating-shaft member rotates in a first rotation direction, the rotation member may move in the first direction while rotating in the first rotation direction.

According to an embodiment, in a case that the rotating-shaft member rotates in a second rotation direction opposite to the first rotation direction, the rotation member and the cleaning member coupling may rotate in the second rotation direction. In a case that the rotating-shaft member rotates in the second rotation direction in a state that the rotation member moved in the first direction, the rotation member may move in the second direction while rotating in the second rotation direction.

According to an embodiment, the cleaning member coupling and the plurality of cleaning members each include one or more magnetic bodies configured so that the cleaning member coupling is magnetically coupleable to each of the plurality of cleaning members.

According to an embodiment, the plurality of cleaning members include a plurality of uneven (concavoconvex) coupling structures, respectively, and the cleaning member coupling includes a plurality of protrusions coupleable to the plurality of cleaning members, by engaging with the plurality of uneven (concavoconvex) coupling structures, respectively.

According to an embodiment, the rotation member includes a first locking part, and the robot cleaner includes an accommodating case that includes an upper surface disposed above the rotation member and the plurality of cleaning members when the cleaning member coupling is coupled to the plurality of cleaning members, and a second locking part configured to engage and couple with the first locking part as the rotation member rotates in a first direction, and to be released from the first locking part as the rotation member rotates in a second direction opposite to the first rotation direction.

According to an embodiment, the accommodating case includes a side surface that, together with the upper surface, defines an internal space for accommodating at least a part of the rotation member or at least one of the plurality of cleaning members when the cleaning member coupling is coupled to the plurality of cleaning members. The accommodating case may include a locking rib extending parallel to the upper surface from a lower end of the side surface.

According to an embodiment, in a case that the rotation member moves in the first direction in a state that the cleaning member coupling is coupled to the plurality of cleaning members with one or more cleaning members of the plurality of cleaning members accommodated in the internal space and one or more cleaning members of the plurality of cleaning members outside the inner space, a cleaning member of the one or more cleaning members outside the internal space may be detached and thereby released from the cleaning member coupling at least partially by resistance of the locking rib. Then, in a case that the rotation member moves in the second direction, the cleaning member adjacent to the locking rib amongst the one or more cleaning members accommodated in the internal space may move out of the internal space in a state of being coupled to the cleaning member coupling.

According to an embodiment, the first locking part and the second locking part may have inclined structures corresponding to each other and that are coupleable to each other to thereby couple the first locking part and the second locking part together. When the first locking part and the second locking part are coupled together, the rotation member may move in the first direction.

According to an embodiment, the first locking part includes a first opening through which a part of the second locking part is insertable, and a first inclined part adjacent to the first opening to guide the insertion of the part of the second locking part.

According to an embodiment, the first inclined part may be inclined downward in a direction in which the part of the second locking part is inserted.

According to an embodiment, the second locking part includes a second opening through which part of the first locking a part is insertable, and a second inclined part adjacent to the second opening to guide the insertion of the part of the first locking part.

According to an embodiment, the second inclined part may be inclined upward in a direction in which the part of the first locking part is inserted.

According to an embodiment, the rotation member may be arranged so that the first locking part and the second locking part couple with each other by its rotation in the first rotation direction.

According to an embodiment, the rotation member may be arranged so that the coupling of the first locking part and the second locking part is released by its rotation in the second rotation direction.

In a method of controlling the operation of a robot cleaner according to an embodiment of the present disclosure, the robot cleaner comprises a motor, and a rotating member provided to be detachably coupled to a first cleaning member that is movable in a first direction perpendicular to a floor surface or a second direction opposite to the first direction according to a rotation direction of the motor, the first cleaning member being disposed in contact with the floor surface, and a second cleaning member arranged to be stacked above the first cleaning member to be not in contact with the floor surface. The method comprises determining whether the first cleaning member is required to be replaced; in a case that it is determined that the first cleaning member is required to be replaced, rotating the motor to move the rotation member in the first direction; and rotating the motor to cause the rotation member to move in the second direction, after the first cleaning member is detached from the rotation member.

According to an embodiment, the determining whether the first cleaning member is required to be replaced may be determined based on whether a time duration for which cleaning of the floor surface using the first cleaning member is performed exceeds a reference time.

According to an embodiment, the rotation member may rotate in either a first rotation direction or a second rotation direction opposite to the first rotation direction, according to the rotation direction of the motor. In a case that the rotation member rotates in the first rotation direction, the rotation member may be movable in the first direction.

According to an embodiment, the rotation member may be movable in the second direction in a case that the rotation member rotates in the second rotation direction in the state of being moved in the first direction.

According to an embodiment, the method further comprises controlling the robot cleaner to travel to a predetermined position, in a case that it is determined that the replacement of the first cleaning member is required.

According to various embodiments proposed in the disclosure, the robot cleaner can automatically replace the cleaning cloth by identifying a replacement timing of a cleaning cloth cleaning the floor surface.

According to various embodiments proposed in the disclosure, the robot cleaner can move up and down the rotation member by controlling only a rotation direction of the rotation member without a separate additional configuration.

The effects that can be obtained from exemplary embodiments of the present disclosure are not limited to those described above, and any other effects not mentioned herein will be clearly derived and understood by those having ordinary knowledge in the technical field to which the disclosure belongs from the following description. That is to say, any unintended effects according to carrying out exemplary embodiments of the disclosure may be clearly derived by those having ordinary knowledge in the art from the exemplary embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Figure 1:
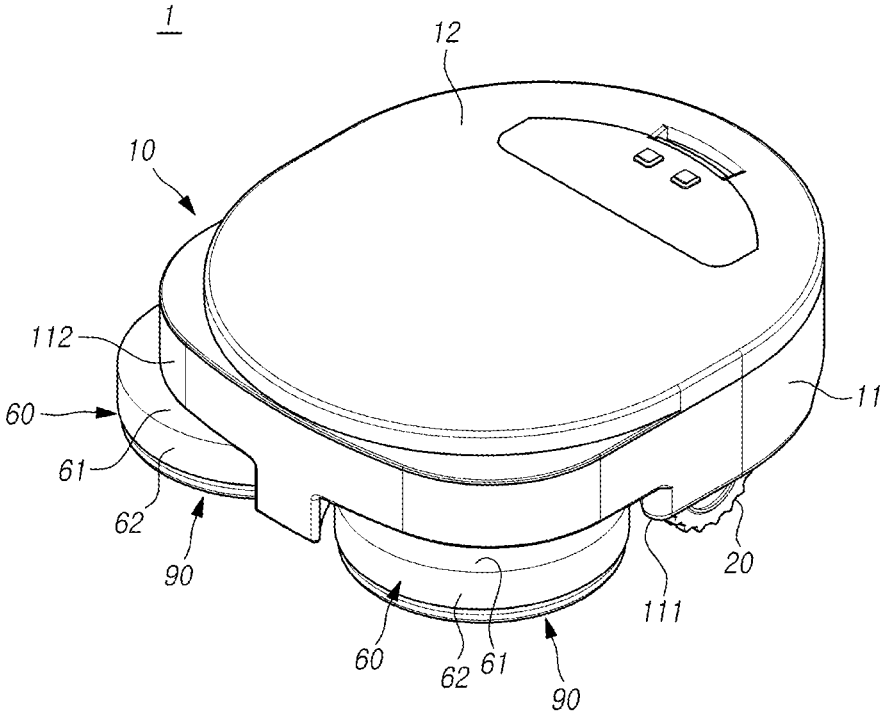
FIG. 1 is a perspective view of a robot cleaner according to an embodiment of the disclosure.

The accompanying drawings are referred to in the following description, and certain examples of implementation are illustrated as examples in the drawings. Further, other examples may be used and structural changes or modifications may be made without departing from the scope of various examples of the present disclosure.

DETAILED DESCRIPTION

Hereinafter, various embodiments of the present disclosure will be described with reference to the drawings in such a detailed manner that those having ordinary knowledge in the technical field to which the disclosure pertains can easily implement the disclosed invention. However, the disclosure may be implemented in several different forms and is not limited to the embodiments described herein. In conjunction with the description of the drawings, like or similar reference numerals may be used for such like or similar components throughout the specification and the drawings. Further, in the drawings and their related descriptions, descriptions of well-known functions and configurations may be omitted for clarity and conciseness.

Figure 2:
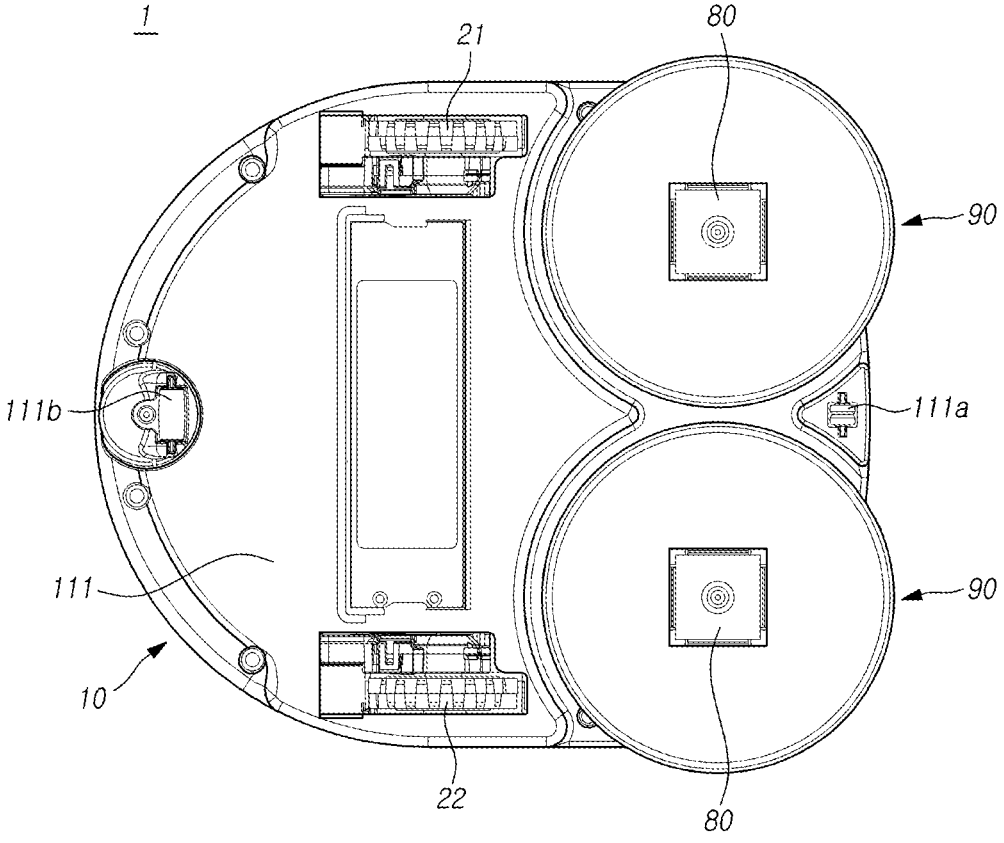
FIG. 2 is a bottom view of a robot cleaner according to an embodiment of the disclosure.
Figure 3:
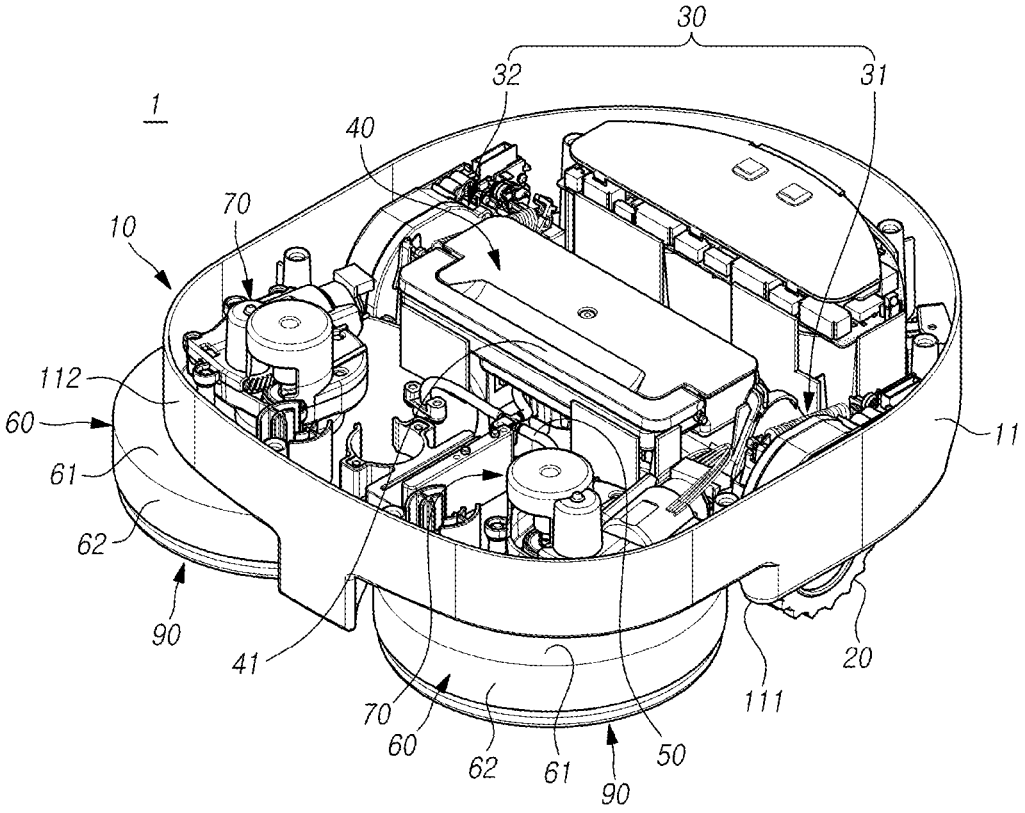
FIG. 3 is a diagram illustrating an internal configuration of a robot cleaner according to an embodiment of the disclosure.
Figure 4:
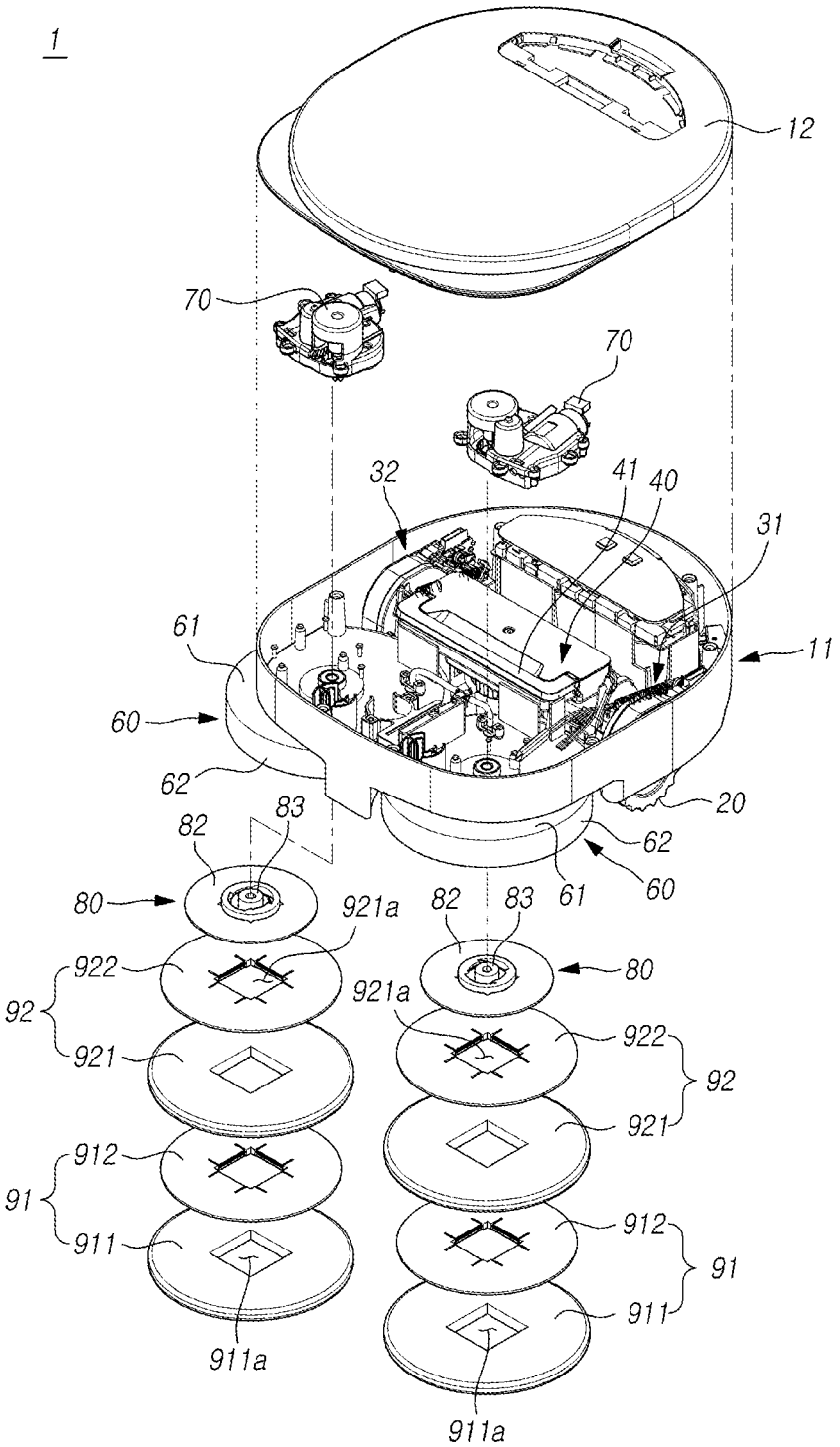
FIG. 4 is an exploded perspective view of a robot cleaner according to an embodiment of the disclosure.

FIG. 1 is a perspective view of a robot cleaner according to an embodiment of the disclosure. FIG. 2 is a bottom view of a robot cleaner according to an embodiment of the disclosure. FIG. 3 is a diagram illustrating an internal configuration of a robot cleaner according to an embodiment of the disclosure. And FIG. 4 is an exploded perspective view of a robot cleaner according to an embodiment of the disclosure.

Hereinafter, an overall configuration of a robot cleaner according to an embodiment of the disclosure will be described with reference to FIGS. 1 to 4. A description related to an embodiment of the disclosure will be mainly focused on, and a description that may be obvious within the scope of the technical level of a person skilled in the art will be simplified or omitted.

Referring to FIGS. 1 and 2, in an embodiment, a robot cleaner 1 may include a body 10. The body 10 may form an overall appearance of the robot cleaner 1, for example.

According to an embodiment, the body 10 may include a main body 11 and an upper cover 12. According to an embodiment, the main body 11 may include a lower part 111 disposed adjacent to the floor surface (or the surface to be cleaned) while the robot cleaner 1 is driven for cleaning, and a side part 112 extending upward from a corner of the lower part 111 to form a side of the robot cleaner. Although not shown in FIG. 1 or 2, according to an embodiment, the robot cleaner 1 may include a bumper capable of mitigating an external impact on the side part 112.

In an embodiment, the main body 11 may have an opened upper portion. The upper cover 12 may be disposed above the main body 11. The upper cover 12 may be disposed to cover an upper opening of the main body 11. In an embodiment, the upper cover 12 may be detachably coupled to the main body 11. After the upper cover 12 is separated, the user may access the components inside the body 10 through an upper opening of the main body 11. According to an embodiment, the main body 11 and the upper cover 12 may be integrally formed.

According to an embodiment, as shown in FIG. 2, one side support 111*b* may be provided in a lower part 111 of the main body 11. The one side support 111*b* may be provided at the rear of the lower part 111 (e.g., a rear side with respect to its driving direction when the robot cleaner 1 travels on the floor surface for cleaning). The one side support 111*b* may be, for example, of a cylindrical roller, but it is not limited thereto. The one side support 111*b* may play a role of supporting the rear of the robot cleaner 1 in a situation where a backward pitching occurs, such as e.g., when the robot cleaner 1 is driving in acceleration.

According to an embodiment, other side support 111*a* may be arranged at the lower part 111 of the main body 11. The other side support 111*a* may be provided in the opposite side of the one side support 111*b* in the lower part 111, for example, in front of the robot cleaner 1 (for example, in the front side with respect to the driving direction when the robot cleaner 1 travels on the floor for cleaning). The other side support 111*a* may be, for example, of a cylindrical roller, but it is not limited thereto.

According to an embodiment, the robot cleaner 1 may include a first wheel 21 and a second wheel 22. The first wheel 21 and the second wheel 22 may be respectively arranged on the left and right sides of the lower part 111 of the main body 11 of the robot cleaner 1. The robot cleaner 1 may control its driving speed or driving direction by independently controlling the rotation of the first wheel 21 and the second wheel 22. The robot cleaner 1 may monitor the surrounding environment while driving indoors or outdoors using, for example, the first wheel 21 and the second wheel 22, and may perform various functions accordingly. According to an embodiment, each of the first wheel 21 and the second wheel 22 may be disposed so that a portion thereof passes through the lower part 111 of the main body 11. Each of the first wheel 21 and the second wheel 22 may be disposed such that a portion thereof is exposed to the outside of the lower part 111 of the main body 11.

According to an embodiment, the robot cleaner 1 may include an accommodating case 60. The accommodating case 60 may be disposed in a front part of the robot cleaner 1, for example. Although not specifically shown in FIGS. 1 and 2, in an embodiment, the accommodating case 60 may have a cylindrical shape with an opened lower part and an empty interior, but it is not limited thereto and may have a pillar shape with a polygonal cross-section. According to an embodiment, the cleaning member 90 may be coupled to the robot cleaner 1 in an empty space inside and/or below the accommodating case 60. Although not specifically illustrated in FIGS. 1 and 2, according to an embodiment, a plurality of cleaning members 90 may be disposed stacked in an inner empty space and/or a lower part of the accommodating case 60. According to an embodiment, the accommodating case 60 may accommodate at least one of a plurality of stacked cleaning members 90 within the empty space. According to an embodiment, each of a plurality of cleaning members 90 may be coupled to the rotation member 80, as described below, and the accommodating case 60 may receive at least a part of the rotation member 80 in such an inner empty space. The accommodating case 60 may be integrally formed with the main body 11, but it is not limited thereto and may be provided detachably from the main body 11. In an embodiment, a plurality of accommodating cases 60 may be provided. In FIGS. 1 and 2, it is shown only the cleaning member 90 adjacent to the floor surface amongst the plurality of cleaning members 90 coupled to the robot cleaner 1 according to an embodiment.

Referring to FIG. 3, a state is shown that the upper cover 12 is detached the main body 11 of the body 10 of the robot cleaner 1 according to an embodiment. As shown, various components for the operation of the robot cleaner 1 are arranged in a space inside the body 10. Referring to FIG. 4, some configuration of the robot cleaner 1 is illustrated in such a separate manner that the configuration of the robot cleaner 1 according to an embodiment is better understood.

According to an embodiment, the robot cleaner 1 may include a first wheel driver 31 and a second wheel driver 32.

Although not explicitly shown, each of the first wheel driver 31 and the second wheel driver 32 may be connected to the first wheel 21 and the second wheel 22. The first wheel driver 31 and the second wheel driver 32 may be accommodated at the positions corresponding to the first wheel 21 and the second wheel 22, respectively, within the internal space of the body 10. Each of the first wheel driver 31 and the second wheel driver 32 may be accommodated in the body 10 to provide rotational force to the corresponding first wheel 21 or second wheel 22, respectively. The first and second wheels 21 and 22 can receive the rotational power from the first and second wheel drivers 31 and 32, respectively, for rotation thereof.

Figure 5:
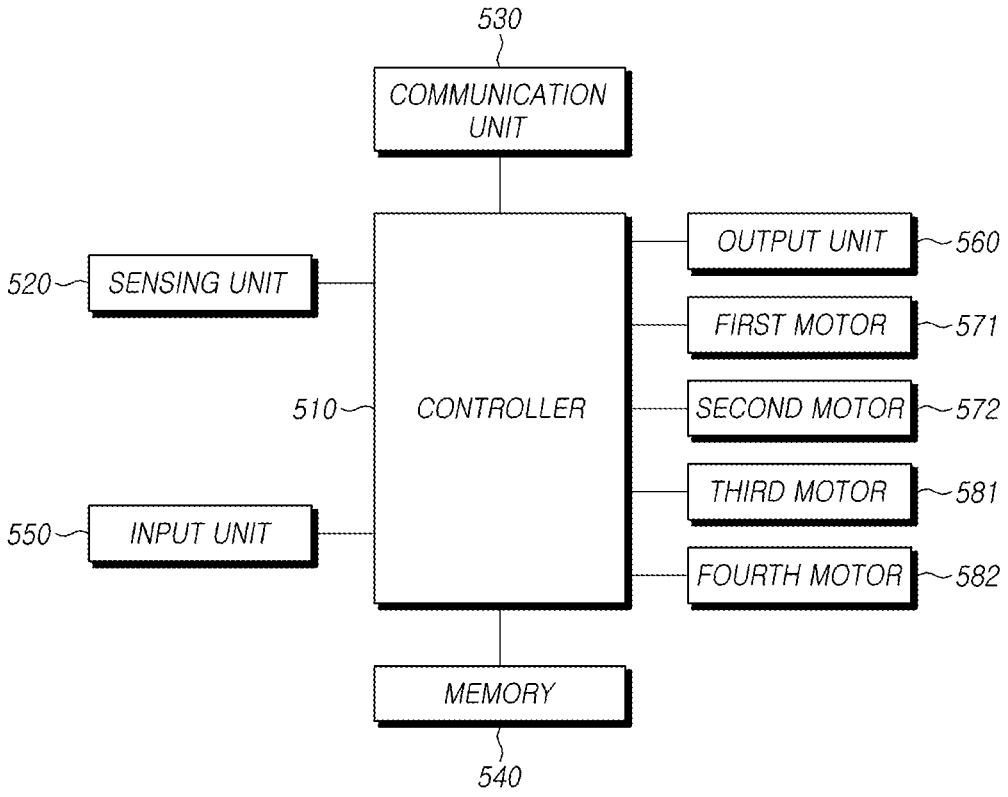
FIG. 5 is a schematic block diagram showing a functional relationship between components in conjunction with an operation of a robot cleaner according to an embodiment of the disclosure.

According to an embodiment, the first wheel driver 31 may include a corresponding motor (e.g., a first motor 571 of FIG. 5). According to an embodiment, the second wheel driver 32 may include a corresponding motor (e.g., a second motor 572 of FIG. 5). The robot cleaner 1 may control the operation of the first wheel 21 or the second wheel 22 by adjusting the rotational speed and/or the rotational direction of each motor corresponding to the first wheel driver 31 and the second wheel driver 32, respectively.

According to an embodiment, the robot cleaner 1 may include a liquid storage 40. The liquid storage 40 may store, for example, a liquid for wet cleaning. The liquid stored in the liquid storage 40 may be, for example, water, but is not limited thereto and it may be any liquid material such as e.g., soap or solvent used for cleaning. The liquid storage 40 may be detachably placed in an accommodating space within the body 10. A user may access the liquid storage 40 by separating the upper cover 12 from the main body 11 to open an upper portion of the main body 11. According to an embodiment, the liquid storage 40 may include a gripping part 41. The gripping part 41 may be, for example, provided for providing a gripping part that can be conveniently gripped when the user separates and carry the liquid storage 40.

According to an embodiment, the robot cleaner 1 may include a liquid transfer unit 50. The liquid transfer unit 50 may have, for example, one end connected to the liquid storage 40 to communicate with fluid. The liquid transfer unit 50 may have, for example, the other end arranged to supply the liquid to the cleaning member 90 disposed below the robot cleaner 1. In an embodiment, the other end of the liquid transfer unit 50 may be provided to pass through the accommodating case 60 of the lower part 111 of the main body 11 or a portion adjacent thereto to face the cleaning member 90. In an embodiment, the liquid transfer unit 50 may be provided as many as the number of cleaning drivers 70 provided in the robot cleaner 1. The liquid transfer unit 50 may be, for example, a pipe or a hose.

According to an embodiment, the robot cleaner 1 may include one or more cleaning drivers 70. According to an embodiment, the robot cleaner 1 may include a plurality of rotation members 80 respectively corresponding to one or more cleaning drivers 70. According to an embodiment, each cleaning driver 70 may include a corresponding motor (e.g., third motor 581 or fourth motor 582 of FIG. 5) and a rotating-shaft member (not shown in FIGS. 1 to 4) configured to transmit the rotational force of the motor to the corresponding rotation member 80 below. Although not shown in detail, the motor of each cleaning driver 70 may be disposed to transmit the rotational force to an upper part of the rotating-shaft member. Although not shown in detail, each rotating-shaft member may allow the corresponding rotation member 80 to rotate together according to the rotation of the motor.

According to an embodiment, although not explicitly shown in FIG. 3 or FIG. 4, the rotating-shaft member of each cleaning driver 70 may extend to have a predetermined length toward the bottom surface, passing through the upper part of the accommodating case 60 (hereinafter, such an extending direction of the rotating-shaft member will be referred to as "longitudinal direction"). According to one embodiment, the rotating-shaft member extending through the upper part of the accommodating case 60 may be coupled to the corresponding rotation member 80 beneath the accommodating case 60.

According to an embodiment, the cleaning member 90 may be detachably coupled to the robot cleaner 1. According to an embodiment, a plurality of cleaning members 90 may be detachably coupled to one rotation member 80. According to an embodiment, a plurality of cleaning members 90 may be coupled to a cleaning member coupling (not shown in FIGS. 1 to 4) of the rotation member 80. Referring to FIG. 4, according to an embodiment, the robot cleaner 1 may include a first cleaning member 91 and a second cleaning member 92. The first cleaning member 91 may be disposed adjacent to the floor surface, for example. The second cleaning member 92 may be disposed above the first cleaning member 91, for example. The second cleaning member 92 may be positioned so as not to be in contact with the bottom surface, for example. Throughout the disclosure, for convenience of explanation, the cleaning member arranged to be used for cleaning in contact with the floor surface at the outermost amongst a plurality of cleaning members will be referred to as a 'first' cleaning member 91. In the present disclosure, for convenience of explanation, the cleaning member disposed right above the first cleaning member 91 and coming not yet into contact with the floor surface, but being possibly used for cleaning by coming into contact with the floor surface after the first cleaning member 91 is released, will be referred to as a 'second' cleaning member 92. According to an embodiment, three or more cleaning members 90 may be coupled to each rotation member 80, but for convenience of description, description below will be made on the basis of a circumstance in which the first cleaning member 91 and the second cleaning member 92 are coupled together.

According to an embodiment, the first cleaning member 91 may include a first cleaning cloth 911. The robot cleaner 1 may perform cleaning of the floor surface using the first cleaning cloth 911. Here, the first cleaning cloth 911 may be, for example, a dry mop or a damp mop. The first cleaning cloth 911 may be made of various fiber materials such as, for example, a microfiber cloth, a mop, a nonwoven fabric, a brush or the like. According to an embodiment, the first cleaning cloth 911 may include a first hollow part **911*a*. The first hollow part 911*a* may have, for example, a circular shape or a polygonal shape (e.g., a square shape). The shape of the first hollow part 911*a* may correspond to, for example, a horizontal cross-sectional shape of a central portion (not shown in FIG. 4) of the rotation member 80** to be described later.

According to an embodiment, the first cleaning member 91 may include a first support plate 912. The first support plate 912 may be coupled to an upper surface of the first cleaning cloth 911, for example. The first support plate 912 may be located, for example, on an upper surface that does not face a bottom surface of the first cleaning cloth 911. The first support plate 912 may be formed, for example, to surround at least part of the upper surface of the first cleaning cloth 911 and at least part of an inner circumferential surface of a first hollow part **911*a* of the first cleaning cloth 911. According to an embodiment, the first support plate 912 may have a shape of a disk with a hollow portion formed thereon as a whole. The diameter of the first support plate 912 may be smaller than the diameter of the first cleaning cloth 911. The hollow portion of the first support plate 912 may have a shape and a size corresponding to the first hollow part 911***a* of the first cleaning cloth 911. Although not specifically shown in FIG. 4, according to an embodiment, the first support plate 912 may include a first rib extending downward from the hollow portion of the first support plate 912. The first rib may extend, for example, in a vertical direction from an upper corner forming the hollow portion of the first support plate 912. When the first support plate 912 is disposed on the upper surface of the first cleaning cloth 911, the first rib may be disposed to pass through the first hollow part 911*a* of the first cleaning cloth 911. According to an embodiment, the first rib of the first support plate 912 may be coupled to a cleaning cloth coupling of the corresponding rotation member 80.

According to an embodiment, the second cleaning member 92 may include a second cleaning cloth 921. The robot cleaner 1 may perform cleaning of the floor surface using the second cleaning cloth 921. Here, the second cleaning cloth 921 may be, for example, a mop or a damp (wet) mop. The second cleaning cloth 921 may be made of various fiber materials such as, for example, a microfiber cloth, a rag, a nonwoven fabric, a brush or the like. According to an embodiment, the second cleaning cloth 921 may include a second hollow part 921*a*. The second hollow part 921*a* may have, for example, a circular shape or a polygonal shape (e.g., a square shape). The shape of the second hollow part 921*a* may correspond to, for example, a horizontal cross-sectional shape of a central portion (not shown in FIG. 4) of the rotation member 80.

According to an embodiment, the second cleaning member 92 may include a second support plate 922. The second support plate 922 may be coupled to an upper surface of the second cleaning cloth 921, for example. The second support plate 922 may be, for example, formed to surround example, at least part of the upper surface of the second cleaning cloth 921 and at least part of an inner circumferential surface of a second hollow part 921*a* of the second cleaning cloth 921. According to an embodiment, the second support plate 922 may have a shape of a disk with a hollow portion formed thereon as a whole. The diameter of the second support plate 922 may be smaller than the diameter of the second cleaning cloth 921. For example, the hollow portion of the second support plate 922 may have a shape and a size corresponding to the second hollow part 921*a* of the second cleaning cloth 921.

Although not specifically illustrated in FIG. 4, according to an embodiment, the second support plate 922 may include a second rib extending downward from the hollow portion of the second support plate 922. For example, the second rib may extend in a vertical direction from an upper corner forming the hollow portion of the second support plate 922. When the second support plate 922 is disposed on the upper surface of the second cleaning cloth 921, the second rib may be disposed to pass through the second hollow part 921*a* of the second cleaning cloth 921. According to an embodiment, the second rib of the second support plate 922 may be coupled to the cleaning cloth coupling of the corresponding rotation member 80. According to an embodiment, the first cleaning member 91 and the second cleaning member 92 may have the same configuration or shape, but the disclosure is not limited thereto.

According to an embodiment, each cleaning cloth (911 or 921) and each support plate (912 or 922) may be detachably coupled to each other, but the disclosure is not limited thereto and may be integrally formed. Each cleaning cloth 911 and 921 and each corresponding support plate 912 and 922 may be coupled by a fastening element such as magnets, Velcro, or buttons (female button and male button).

FIG. 5 is a schematic block diagram explaining a functional relationship between various components in conjunction with an operation of a robot cleaner according to an embodiment of the disclosure.

According to an embodiment, the robot cleaner 1 may include a sensing unit 520. The sensing unit 520 may include a plurality of sensors or cameras for detecting the surrounding environment of the robot cleaner 1. The sensing unit 520 may include, for example, a plurality of cameras to capture images in various directions. A range sensor may include, for example, an ultrasonic sensor, a radar sensor, and/or a rider sensor, but is not limited thereto. The sensing unit 520 may include, for example, a microphone or an infrared sensor for detecting its surrounding environment. According to an embodiment, the sensing unit 520 may detect the degree of contamination of each cleaning member coupled to the rotation member 80 of the robot cleaner 1 and being used for cleaning, and the present disclosure is not limited thereto.

According to an embodiment, the robot cleaner 1 may include a communication unit 530. According to an embodiment, the communication unit 530 may include one or more modules that enable wireless communication between the robot cleaner 1 and a wireless communication system, between the robot cleaner 1 and another apparatus, or between the robot cleaner 1 and an external server. According to some embodiments, the communication unit 530 may include one or more modules connecting the robot cleaner 1 to one or more networks. According to an embodiment, the communication unit 530 may include at least one of a mobile communication module, a wireless Internet module, a short-range communication module, and a location information module.

The mobile communication module may transmit and receive wireless signals to and from at least one of a base station, an external terminal, or a server, over a mobile communication network established according to the technical standards or communication methods for mobile communications. The wireless signal may include, for example, various forms of data according to transmission and reception of a voice call signal, a video-phone call signal, or a text/multimedia message.

The wireless Internet module may include, for example, WLAN (Wireless LAN), Wi-Fi (Wireless-Fidelity), Wi-Fi Direct, DLNA (Digital Living Network Alliance), WiBro (Wireless Broadband), WiMAX (World Interoperability for Microwave Access), HSDPA (High Speed Downlink Packet Access), HSUPA (High Speed Uplink Packet Access), LTE (Long Term Evolution), LTE-A (Long Term Evolution-Advanced) or the like, but the disclosure is not limited thereto, and the data transmission and reception may be made according to at least one wireless Internet technology within a range including any other Internet technologies not enumerated above.

The short-range communication module is, for example, for supporting short-range communications, and may support the short-range communications using at least one of Bluetooth, Radio Frequency Identification (RFID), Infrared Data Association (IrDA), Ultra-Wide Band (UWB), ZigBee, Near Field Communication (NFC), Wi-Fi, Wi-Fi Direct, Wireless USB (Universal Serial Bus) technologies. The short-range communication module may support wireless communication, for example, between the robot cleaner 1 and the wireless communication system, between the robot cleaner 1 and another apparatus, or between the robot cleaner 1 and a network where the other apparatus is located. Here, the wireless short-range communication network may be wireless personal area networks.

The location information module is, for example, a module for acquiring the position of the robot cleaner 1, and may be a Global Positioning System (GPS) module or a Wi-Fi module. When the robot cleaner 1 uses the GPS module, information on the location of the robot cleaner 1 may be received using a signal transmitted from a GPS satellite. When the robot cleaner 1 utilizes a Wi-Fi module, the information on the location of the robot cleaner 1 may be received based on information from a wireless access point (AP) that transmits and receives a wireless signal to and from the Wi-Fi module.

According to an embodiment, the robot cleaner 1 may include a memory 540. According to an embodiment, the memory 540 may store data supporting various functions of the robot cleaner 1. The memory 540 may store, for example, a plurality of applications (application programs or applications) used in the robot cleaner 1, data for the operation of the robot cleaner 1, and instructions therefor. At least some of these application programs may be downloaded from an external server by way of wireless communication. Further, at least some of these application programs may be stored in the memory 540 from the time of shipment of the product for execution of the basic functions of robot cleaner 1. The application programs may be stored in the memory 540 and may be driven to perform the operation (or functions) of the robot cleaner 1 under the control of a controller 510. According to some embodiments, the memory 540 may be included as a part of the configuration of the controller 510. According to an embodiment, the memory 540 may store information for setting a driving path of the robot cleaner 1.

According to an embodiment, the robot cleaner 1 may include an input unit 550. The input unit 550 may receive, for example, information on the operation mode of the robot cleaner 1 from a user. The input unit 550 may be configured with devices such as, for example, a keypad, a dome switch, a touch pad (static or capacitive), a jog wheel, a jog switch, or a remote control. In addition to the aforementioned input unit 550, the user may input the information on the operation mode of the robot cleaner 1 using a portable device such as e.g., a terminal.

According to an embodiment, the robot cleaner 1 may include a controller 510. According to an embodiment, the controller 510 may control the operation of the robot cleaner 1, for example, using a signal transmitted from the sensing unit 520, the communication unit 530, or the input unit 550.

According to an embodiment, the controller 510 may control the overall operation of the robot cleaner 1. The controller 510 may control the overall operations of the first motor 571 and the second motor 572 respectively connected to the first and second wheels 21 and 22. According to an embodiment, the controller 510 may rotate the first wheel 21 and/or the second wheel 22 by controlling the operation of the first motor 571 and/or the second motor 572. According to an embodiment, the controller 510 may control the driving direction and speed of the robot cleaner 1 by controlling the first motor 571 and/or the second motor 572.

The controller 510 may control the overall operations of the third motor 581 and the fourth motor 582 disposed to transmit power to each rotation member 80. The controller 510 may control, for example, the rotation of the rotation member 80 and/or the cleaning member 90 by controlling the overall operation of the third motor 581 or the fourth motor 582. According to an embodiment, the controller 510 may control the operation of the third motor 581 and/or the fourth motor 582 to rotate the cleaning member 90 corresponding to each.

The controller 510 may include one or more of a central processing unit (CPU), an application processor (AP), or a communication processor (CP). The controller 510 may be, for example, a micro controller (MCU).

The controller 510 may drive, for example, an operating system or an application program to control hardware or software components connected to the controller 510 and may perform various data processing and operations. Further, the controller 510 may load and process commands or data received from at least one of other components into a volatile memory, and store various data in a nonvolatile memory.

According to an embodiment, the robot cleaner 1 may include an output unit 560. The output unit 560 may provide, for example, visual or auditory information to the user. The output unit 560 may include devices that provide visual or auditory information, such as a display unit, a sound output module, or an alarm unit.

Figure 6:
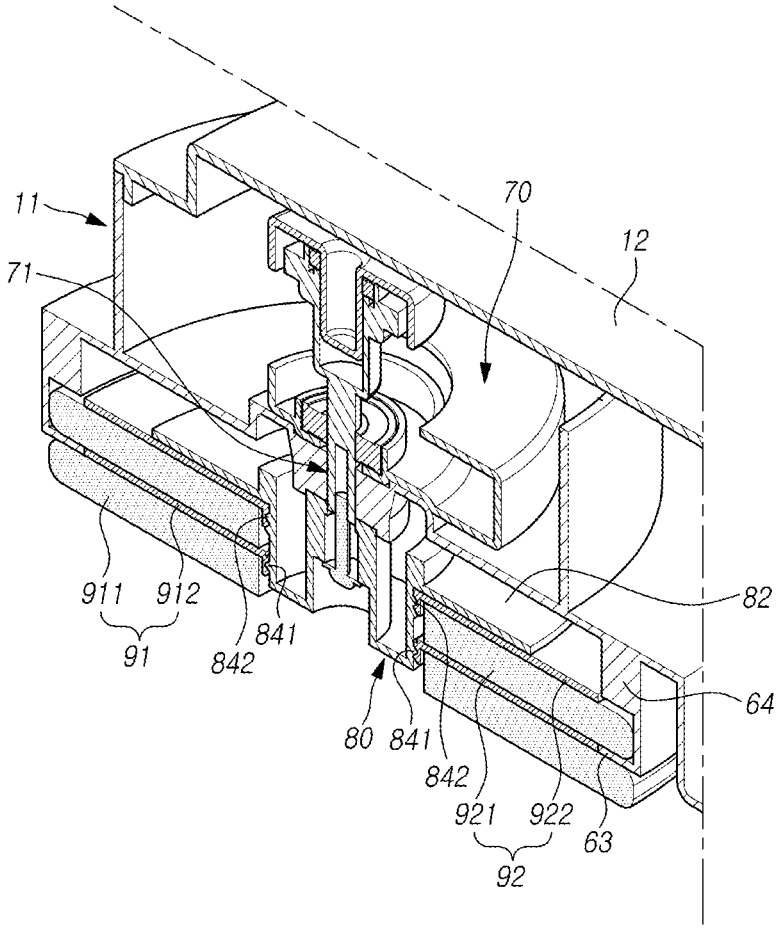
FIG. 6 is a view illustrating a partial cross-section of a robot cleaner according to an embodiment of the disclosure.

FIG. 6 is a view illustrating a partial cross-section of a robot cleaner according to an embodiment of the disclosure. And FIG. 7 is a view illustrating a state in which the drawing of FIG. 6 is viewed from the front.

Hereinafter, referring to FIGS. 6 and 7, among the components of the robot cleaner 1 according to an embodiment, a cleaning driver 70, a rotating-shaft member 71, a rotation member 80, an accommodating case 60 and the cleaning members 91 and 92 coupled thereto that are directly involved in cleaning will be mainly described. Each of the components shown in FIGS. 6 and 7 may be substantially the same as or similar to the components shown in FIGS. 1 to 4. Another embodiment of the disclosure may include any modified components distinguished from those shown in FIGS. 6 and 7.

Figure 7:
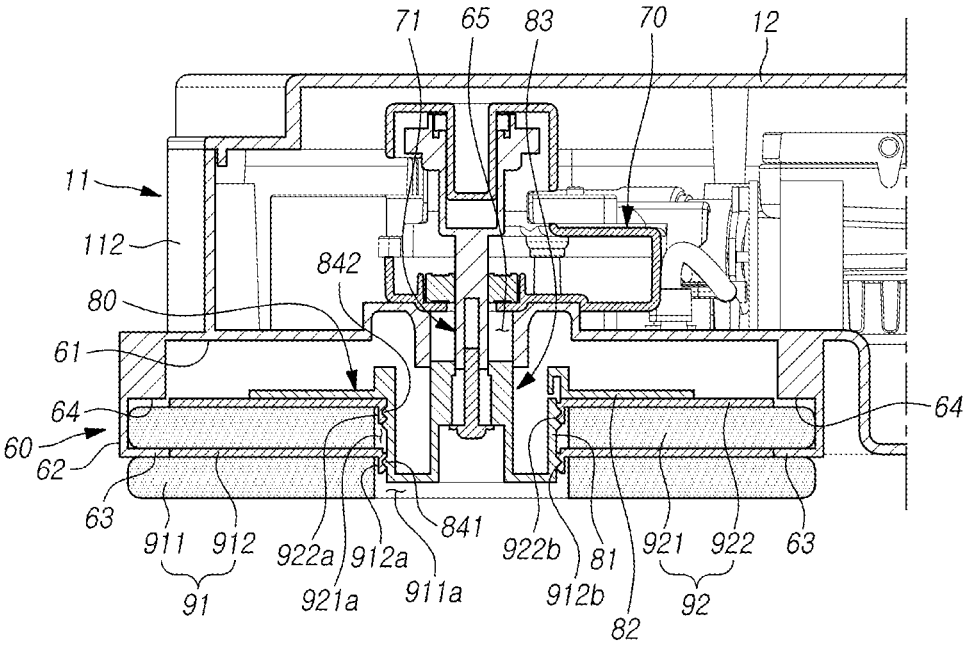
FIG. 7 is a view illustrating a state in which the drawing of FIG. 6 is viewed from the front.

Referring to FIGS. 6 and 7, cross-sections of the cleaning driver 70, the accommodating case 60, the rotation member 80 of the robot cleaner 1, and the first and second cleaning members 91 and 92 coupled to the robot cleaner 10 are illustrated.

According to an embodiment, the cleaning driver 70 may include a motor (corresponding to the motor 581 or the motor 582 of FIG. 5 and not shown in FIGS. 6 and 7) and a rotating-shaft member 71 rotatably coupled by rotation of the motor. According to an embodiment, the rotating-shaft member 71 may be extended by a predetermined length to transmit the driving force generated by the rotation of the motor to the rotation member 80 located below. According to an embodiment, the rotating-shaft member 71 may extend in a direction perpendicular to the floor surface. According to an embodiment, the rotating-shaft member 71 may extend along the longitudinal direction of the robot cleaner 1. Although not specifically illustrated in the drawing, in an embodiment, the rotating-shaft member 71 may have a gear structure disposed in an internal accommodation space of the robot cleaner 1 upward along the longitudinal direction. According to an embodiment, the gear structure of the rotating-shaft member 71 may rotate by means of coupling of a motor and a worm gear disposed in the internal accommodation space. According to an embodiment, the rotating-shaft member 71 may rotate clockwise or counterclockwise according to the rotation direction of the motor. According to an embodiment, the rotating-shaft member 71 may extend passing through the accommodating case 60.

Figure 8A:
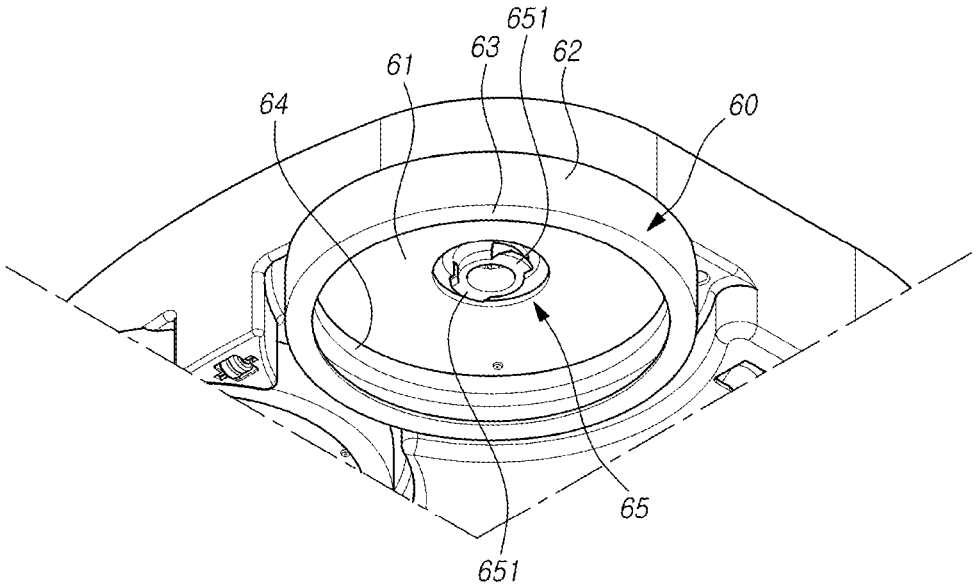
FIG. 8A is a view illustrating a state in which an accommodating case according to an embodiment of the disclosure is viewed obliquely from the bottom.
Figure 8B:
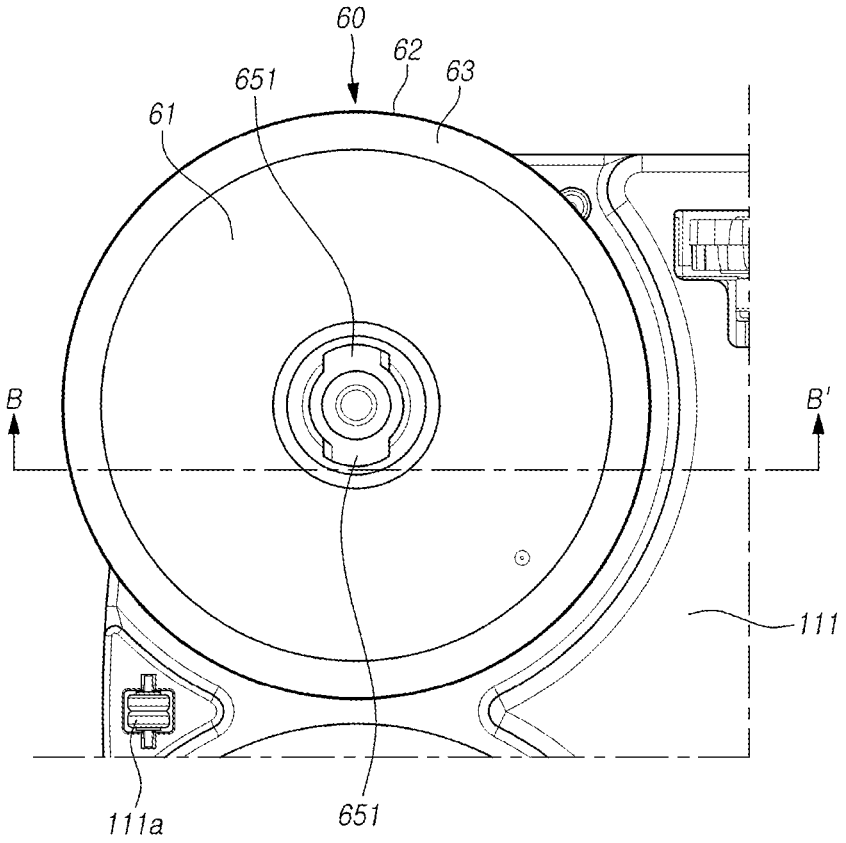
FIG. 8B is a plan view of an accommodating case viewed from the bottom, according to an embodiment of the disclosure.
Figure 9:
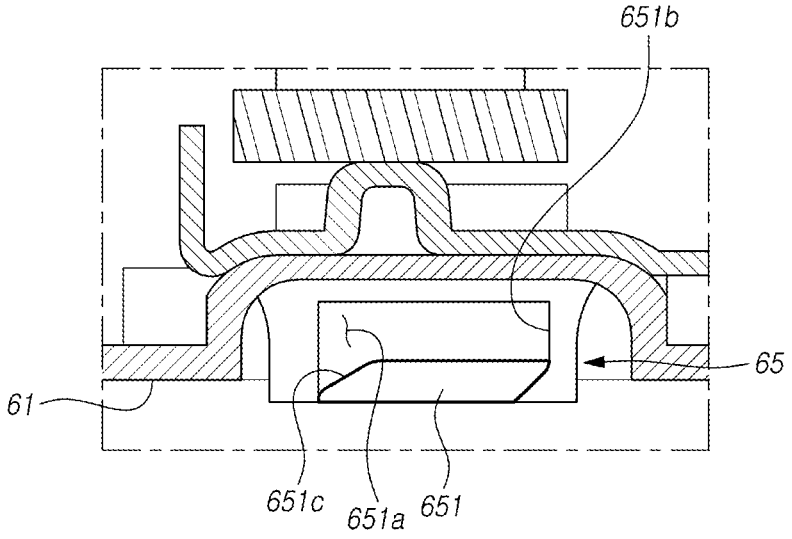
FIG. 9 is a cross-sectional view taken along a line B-B' of FIG. 8B.

In this connection, FIG. 8A illustrates a perspective view of the accommodating case according to an embodiment of the disclosure, viewed obliquely from the bottom. FIG. 8B illustrates a bottom view of the accommodating case according to an embodiment of the disclosure, viewed from the bottom. And FIG. 9 illustrates a partial cross-sectional view taken along a line B-B' of FIG. 8B.

Hereinafter, a structure of the accommodating case according to an embodiment of the disclosure will be described in more detail with reference to FIGS. 8A, 8B, and 9 together, in addition to FIGS. 6 and 7.

According to an embodiment, the accommodating case 60 may include an upper surface 61 and a side surface 62 extending downward from an edge of the upper surface 61. According to an embodiment, the upper surface of the accommodating case 60 may have a generally circular shape, but this disclosure is not limited thereto. According to an embodiment, the accommodating case 60 may include a locking rib 63 protruding and extending from one lower end of the side surface 62. The locking rib 63 may extend inward from the lower end of the accommodating case 60, for example. The locking rib 63 may extend, for example, from the side surface 62 of the accommodating case 60 in a direction perpendicular thereto (e.g., a direction facing parallel to the upper surface 61). For example, the locking rib 63 may be positioned between the first cleaning member 91 and the second cleaning member 92, as described later. The locking rib 63 may provide, for example, a locking structure configured so that the robot cleaner 1 causes to release coupling of the first cleaning member 91. According to an embodiment, the upper surface 61, the side surface 62, and the locking rib 63 of the accommodating case 60 may define the internal space of the accommodating case 60.

According to an embodiment, the accommodating case 60 may include a locking jaw 64 and an insertion groove 65. According to an embodiment, the insertion groove 65 may be provided on upper part of the internal space of the accommodating case 60. For example, the insertion groove 65 may be formed with a recess upward from the internal space in the center of the upper surface 61 of the accommodating case 60. According to an embodiment, a hollow portion for the rotating-shaft member 71 of the cleaning driver 70 to pass therethrough may be formed in the central portion of the upper surface 61 of the accommodating case 60 and the insertion groove 65.

According to an embodiment, the insertion groove 65 may include a second locking part 651. According to an embodiment, the second locking part 651 may have a structure corresponding to a first locking part 831 of the rotation member 80 to be described later. According to an embodiment, the second locking part 651 may be engaged with the first locking part 831 on the rotation member 80, as the rotation member 80 (to be described later) rotates in a predetermined direction (e.g., a first rotation direction ① of FIG. 11A). According to an embodiment, each of the second locking part 651 and the first locking part 831 may have an inclined structure corresponding to each other. According to an embodiment, the second locking part 651 and the first locking part 831 may be coupled to each other by spiral coupling of the corresponding inclined structures, but the disclosure is not limited thereto. According to an embodiment, the second locking part 651 may be released from the first locking part 831 on the rotation member 80, as the rotation member 80 (to be described later) rotates in the direction opposite to the predetermined direction (e.g., the second rotation direction ② of FIG. 11A).

According to an embodiment, the second locking part 651 may include a second opening 651*a* provided at one side with respect to the circumferential direction. The second opening 651*a* may be, for example, an inlet through which a portion of the first locking part 831 of the rotation member 80 is inserted. The second opening 651*a* may be, for example, an inlet through which a portion of the first locking part 831 is inserted, when the rotation member 80 rotates in a predetermined direction (e.g., the first rotation direction ①). According to an embodiment, when the rotation member 80 rotates in the first rotation direction ① so that the second locking part 651 and the first locking part 831 are engaged with each other, a portion of the first locking part 831 may be inserted into the second opening 651*a* of the second locking part 651, and the rotation member 80 may move upward.

According to an embodiment, the second locking part 651 may include a second inclined part 651*c* for guiding insertion of a portion of the first locking part 831. The second inclined part 651*c* may be formed, for example, in a position adjacent to the second opening 651*a*. The second inclined part 651*c* may be formed, for example, to be inclined upward in a direction in which a portion of the first locking part 831 is inserted. When the first locking part 831 is inserted into the second opening 651*a* of the second locking part 651 by forming of the second inclined part 651*c*, the rotation member 80 may move upward in a fixed state of the accommodating case 60.

According to an embodiment, the second locking part 651 may include a second closing part 651*b* provided on the other side opposite to the above second opening 651*a* along the circumferential direction. As described later, when a portion of the first locking part 831 of the rotating member 80 is inserted through the second opening 651*a* of the second locking part 651 to that the second locking part 651 is coupled to the first locking part 831 of the rotating member 80, the second closing part 651*b* may act to block advancing of the first locking part 831 of the rotation member 80 to stop the rotation of the rotation member 80. According to an embodiment, when the rotation member 80 rotates in the first rotation direction ① so that the second locking part 651 and the first locking part 831 are engaged with each other, coming into contact with the second closing part 651*b*, the first locking part 831 may not further advance, so that the coupling can be completed. According to an embodiment, on the contrary, in a case that the rotation member 80 rotates in the second rotation direction ②, the coupling between the second locking part 651 and the first locking part 831 may be released as described above. According to an embodiment, in a case that the rotation member 80 rotates in the second rotation direction ② to get the coupling between the second locking part 651 and the first locking part 831 to be released, the second locking part 651 and the first locking part 831 do not interfere with each other's rotation, so the rotation member 80 may continue to rotate in the second rotation direction ②.

Referring back to FIGS. 6 and 7, the rotation member 80 may be coupled to the rotating-shaft member 71 underneath the accommodating case 60. According to an embodiment, in a case that the rotating-shaft 71 operates as a rotating shaft of the rotation member 80 so that the rotating-shaft member 71 rotates clockwise or counterclockwise, the rotation member 80 may rotate in the same direction.

Figure 10:
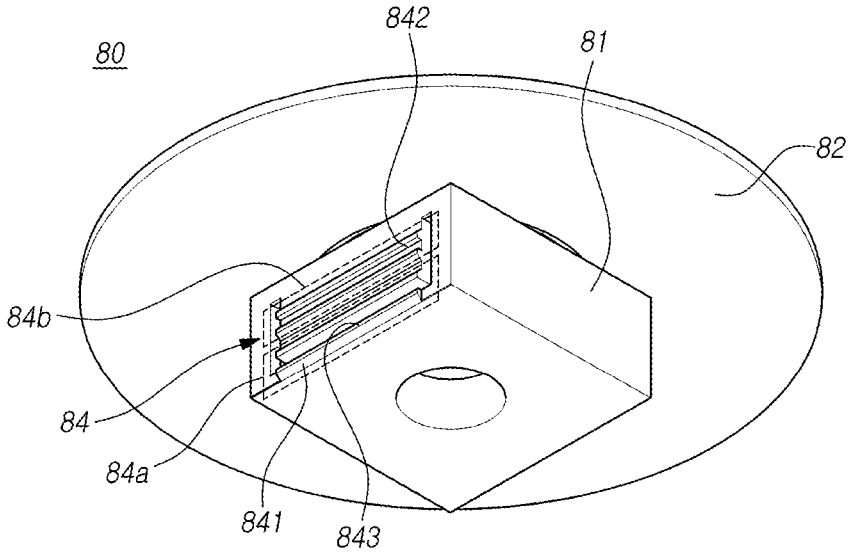
FIG. 10 is a lower perspective view of a rotation member of a robot cleaner according to an embodiment of the disclosure.
Figure 11A:
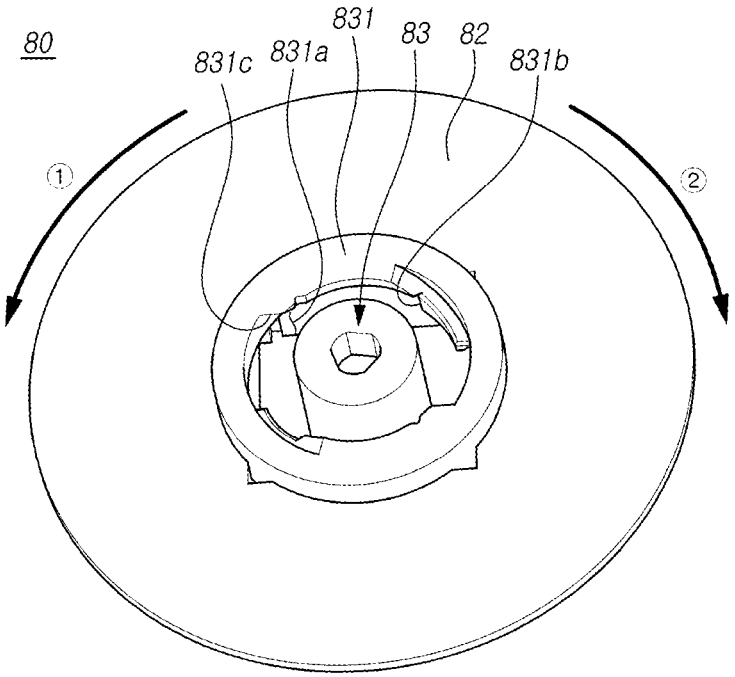
FIG. 11A is an upper perspective view of a rotation member according to an embodiment of the disclosure.
Figure 11B:
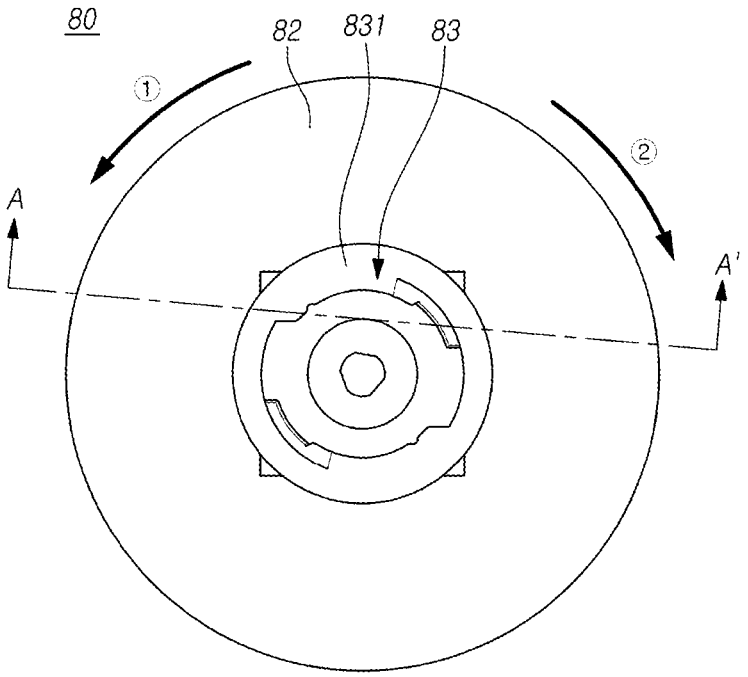
FIG. 11B is an upper plan view of a rotation member according to an embodiment of the disclosure.
Figure 12:
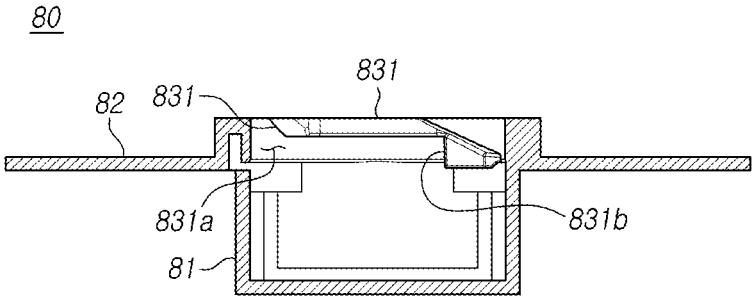
FIG. 12 is a cross-sectional view taken along a Line A-A' of FIG. 11B.

FIG. 10 is a lower perspective view of a rotation member of a robot cleaner according to an embodiment of the disclosure. FIG. 11A is an upper perspective view of a rotation member according to an embodiment of the disclosure. FIG. 11B is an upper plan view of a rotation member according to an embodiment of the disclosure. And FIG. 12 is a cross-sectional view taken along a line A-A' of FIG. 11B.

Further to FIGS. 6 to 9, a structure of a rotation member according to an embodiment will be described in more detail with reference to FIG. 10 and FIGS. 11A to 110, hereinafter.

According to an embodiment, the rotation member 80 may include a central part 81, a wing part 82 extending horizontally from the upper side of the central part 81, and an insertion part 83 disposed at the upper center of the wing part 82. According to an embodiment, the insertion part 83 may be inserted into, for example, the insertion groove 65 located in the upper center of the accommodating case 60.

According to an embodiment, the central part 81 may have an outer periphery of a polygonal pillar (e.g., a square pillar) shape. According to an embodiment, the central portion of the rotation member 80 may have a cylindrical shape of outer periphery.

According to an embodiment, the wing part 82 of the rotation member 80 may generally have a disk shape, but the disclosure is not limited thereto. According to an embodiment, as described above, the insertion part 83 may be inserted into the insertion groove 65 located in the upper center of the accommodating case 60. According to an embodiment, the insertion part 83 and the wing part 82 of the rotation member 80 may be accommodated in the internal space of the accommodating case 60. According to an embodiment, as illustrated in FIG. 7, a part of the central part 81 of the rotation member 80, for example, a part extending directly from the wing part 82, may be accommodated in the internal space of the accommodating case 60. According to one embodiment, the remaining central part 81 of the rotation member 80, for example, a free end at a distal position from the wing part 82, may protrude outward from the internal space of the accommodating case 60.

According to an embodiment, the rotation member 80 may include a cleaning member coupling 84 disposed on at least a part of an outer circumferential surface of the central part 81. FIGS. 7 and 10, according to an embodiment, the cleaning member coupling 84 may include a plurality of locking protrusions 843 protruding from a surface of the central part 81. According to an embodiment, as shown in FIGS. 7 and 10, when the cleaning member coupling 84 is configured to include the locking protrusion 843, each locking protrusion 843 may be coupled to each cleaning member 90 in a locking coupling method as described later, but the present disclosure is not limited thereto.

According to an embodiment, the cleaning member coupling 84 provided in the central part 81 may include a plurality of sub-coupling portions spaced apart in the vertical direction (e.g., the longitudinal direction of the rotating-shaft member 71). As shown in FIGS. 7 and 10, in an embodiment, the cleaning member coupling 84 may include a first sub-coupling 841 and a second sub-coupling 842. For example, the cleaning member coupling 84 may be respectively coupled to the cleaning member 90 as many as the number of the sub-coupling portions 841 and 842. The cleaning member 90 coupled to each of the sub-coupling portions 841 and 842 may be stacked in the vertical direction (e.g., the longitudinal direction of the rotating-shaft member 71).

According to an embodiment, the first sub-coupling 841 may be positioned, for example, at a lower part of the central part 81 (e.g., a first part 84*a* of FIG. 10). The first sub-coupling 841 may be coupled to the first cleaning member 91, for example. In an embodiment, the first part 84*a* may be provided, for example, such that the first cleaning member 91 coupled to the first part 84*a* is located out of (or below) the internal space of the accommodating case 60. The first cleaning member 91 coupled to the first sub-coupling 841 may be positioned out of the accommodating case 60 to be in contact with the floor surface for use in cleaning the floor surface. A second sub-coupling 842 may be located, for example, above the first sub-coupling 841 (e.g., the second part 84*b* of FIG. 10). The second sub-coupling 842 may be coupled to, for example, the second cleaning member 92. For example, the second part 84*b* may be provided so that the second cleaning member 92 coupled to the second part 84*b* is positioned inside the accommodating case 60.

According to an embodiment, the insertion part 83 may include a first locking part 831. The first locking part 831 may protrude from the inner circumferential surface of the insertion part 83, for example. As described above, the first locking part 831 may be engaged with and coupled to the second locking part 651 formed in the insertion groove 65 of the accommodating case 60. The first locking part 831 may be, for example, engaged with the second locking part 651 when the rotation member 80 rotates in a predetermined direction (e.g., the first rotation direction ①). According to an embodiment, when the second locking part 651 and the first locking part 831 are coupled to each other, the first locking part 831 may be located more outside than the second locking part 651, and the disclosure is not limited thereto.

According to an embodiment, the first locking part 831 may include a first opening 831*a* provided at one side with respect to the circumferential direction. The first opening 831*a* may be, for example, an inlet through which a portion of the second locking part 651 of the accommodating case 60 is inserted.

In an embodiment, in a case that the first locking part 831 and the second locking part 651 are engaged, a portion of the first locking part 831 may be inserted into the second opening 651*a* of the second locking part 651. In an embodiment, in a case that the first locking part 831 and the second locking part 651 are engaged, a portion of the second locking part 651 may be inserted into the first opening 831*a* of the first locking part 831.

According to an embodiment, the first locking part 831 may include a first inclined part 831*c* for guiding the insertion of the second locking part 651. The first inclined part 831*c* may be formed, for example, in a portion adjacent to the first opening 831*a*. For example, the first inclined part 831*c* may be formed to be inclined downward in a direction that a portion of the second locking part 651 is inserted. When the second locking part 651 is inserted into the first opening 831*a* of the first locking part 831 by forming of the first inclined part 831*c*, the rotation member 80 may move upward while the accommodating case 60 is in a fixed state.

According to an embodiment, the first locking part 831 may include a first closing part 831*b* provided on the other side that is opposite to the first opening 831*a* along the circumferential direction. For example, the first closing part 831*b* may cause to cease the rotation of the first rotation member 80 in the first rotation direction ①, when the first rotation member 80 rotates in the first rotation direction so that the second locking part 651 is inserted through the first opening 831*a* of the first locking part 831 to be coupled thereto.

According to an embodiment, each of the first and second cleaning members 91 and 92 may include the first support plate 912 or the second support plate 922, as described above. As illustrated in FIG. 7, each of the support plates 912 or 922 may include a first rib 912*a* and a second rib 922*a* extending downward from each corresponding hollow portion. Each of the first rib 912*a* and the second rib 922*a* may extend in a vertical direction from an upper edge forming the hollow portion of each corresponding support plate 912 or 922.

According to an embodiment, the first rib 912*a* or the second rib 922*a* may be disposed to pass through the first hollow part 911*a* of the first cleaning cloth 911 or the second hollow part 921*a* of the second cleaning cloth 921. According to an embodiment, the first rib 912*a* of the first support plate 912 may be coupled to the cleaning cloth coupling 84 of the corresponding rotation member 80. According to an embodiment, the second rib 922*a* of the second support plate 922 may be coupled to the cleaning cloth coupling 84 of the corresponding rotation member 80.

According to an embodiment, the first support plate 912 may include a first coupling 912*b* on the first rib 912*a*. The first coupling 912*b* may be coupled to the cleaning member coupling 84, for example. The first coupling 912*b* may be coupled to one (for example, sub-coupling 841) of a plurality of sub-coupling portions 841 and 842. According to an embodiment, the second support plate 922 may include a second coupling 922*b* on the second rib 922*a*. The second coupling 922*b* may be coupled to the cleaning member coupling 84, for example. The second coupling 922*b* may be coupled to one (for example, sub-coupling 842) of the plurality of sub-coupling portions 841 and 842. According to an embodiment, when the second cleaning member 92 is inserted into the rotation member 80, it may be initially coupled to the first sub-coupling 841, and then moved by an external force to be coupled to the second sub-coupling 842. According to an embodiment, after the second cleaning member 92 is disposed to be coupled to the second sub-coupling 842, the first cleaning member 91 may be disposed to be coupled to the first sub-coupling 841.

According to an embodiment, the first rib 912*a* of the first cleaning member 91 may be made of an elastic material. For example, the first rib 912*a* may be rotated radially outward to mount (or attach) or detach the first coupling 912*b* onto or from the cleaning member coupling 84. The first rib 912*a* may be rotated about one end in contact with the inner circumferential surface of the hollow portion of the first support plate 912. The first rib 912*a* may be restored to its original state before its rotation, once the first coupling 912*b* is fully mounted on the cleaning member coupling 84.

According to an embodiment, the second rib 922*a* of the second cleaning member 92 may be made of an elastic material. For example, the second rib 922*a* may be rotated radially outward to mount (or attach) or detach the second coupling 922*b* onto or from the cleaning member coupling 84. The second rib 922*a* may be rotated about one end in contact with the inner circumferential surface of the hollow portion of the second support plate 922. The second rib 922*a* may be restored to its original state before its rotation, once the second coupling 922*b* is fully mounted on the cleaning member coupling 84.

According to an embodiment, the rotation member 80 may move in the vertical direction (e.g., the longitudinally extending direction of the rotating-shaft member 71) by rotation of the motor in the cleaning driver 70. According to an embodiment, rotation of each motor of the cleaning driver 70 may be performed under the control of the controller 510. For example, in a case that the motor of the cleaning driver 70 rotates in a certain direction, the rotating-shaft member 71 may rotate in either direction, such as e.g., the first rotation direction ①. In a case that the rotating-shaft member 71 rotates in the first rotation direction, the rotation member 80 may also move upward along with the rotation in the first rotation direction. According to an embodiment, in a case that the rotation member 80 rotates in the first rotation direction, the rotation member 80 may also move upward along with the rotation in the first rotation direction. For example, in a case that the rotation member 80 rotates in the first rotation direction, the rotation member 80 may move upward due to engagement between the rotation member 80 and the accommodating case 60. For example, in a case that the rotation member 80 rotates in the first rotation direction, a portion of the second locking part 651 of the accommodating case 60 may be inserted into the opening 831*a* of the first locking part 831, thereby moving the rotation member 80 upward.

According to an embodiment, in a case that the motor of the cleaning driver 70 rotates in a direction opposite to the above certain direction, the rotating-shaft member 71 may rotate in the opposite direction, for example, in the second rotation direction ②. In a case that the rotating-shaft member 71 rotates in the second rotation direction ②, the rotation member 80 may also rotate in the second rotation direction together. In a case that the rotation member 80 rotates in the second rotation direction in the state in which the rotation member 80 moved upward, the engagement between the rotation member 80 and the accommodating case 60 may be released and the rotation member 80 may then move downward. In an embodiment, in a case that the rotation member 80 continues to rotate in the second rotation direction ② by the rotation of the motor of the cleaning driver 70 in the state of the engagement between the rotation member 80 and the accommodating case 60 being released, the rotation member 80 may continue its rotation without moving up and down.

According to an embodiment, when the rotation member 80 rotates by motor rotation of the cleaning driver 70, at least one of a plurality of cleaning members 90 coupled to the rotation member 80 may rotate together. Referring to FIGS. 6 to 12, the upward and/or downward movement of the above-described rotation member 80 illustrates an example of the disclosure. According to an embodiment of the present disclosure, another type of lifting mechanism may be used enabling the vertical movement of the rotation member 80.

According to an embodiment, one of the plurality of cleaning members 90 coupled to the rotation member 80, such as the first cleaning member 91, may be disposed outside the accommodating case 60. For example, the first cleaning member 91 adjacent to the floor surface may be disposed outside the accommodating case 60. According to an embodiment, at least one cleaning member 90 may be accommodated within the accommodating case 60. For example, the second cleaning member 92 may be accommodated in the accommodating case 60. The second cleaning member 92 may be, for example, provided to clean the floor surface after the coupling of the first cleaning member 91 is released.

According to an embodiment, the accommodating case 60 may be integrally configured with the main body 11. According to an embodiment, the side surface 62 of the accommodating case 60 may be omitted so that the cleaning members 90 is visible from the outside.

Figure 13:
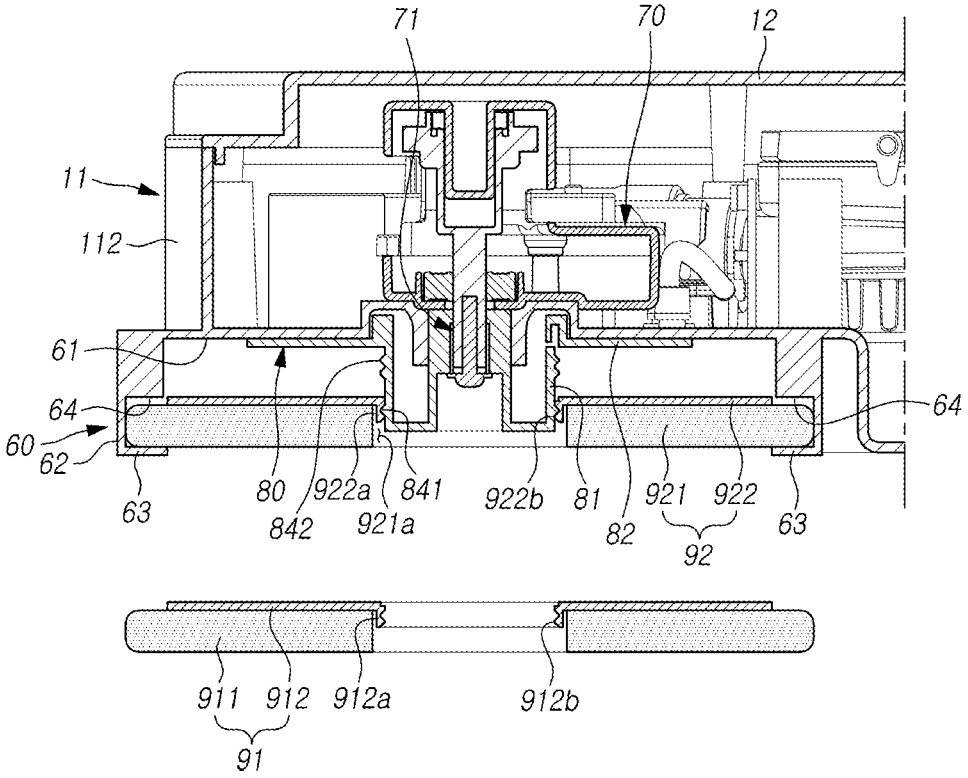
FIGS. 13 and 14 are diagrams illustrating an operation of a robot cleaner according to an embodiment of the disclosure.
Figure 14:
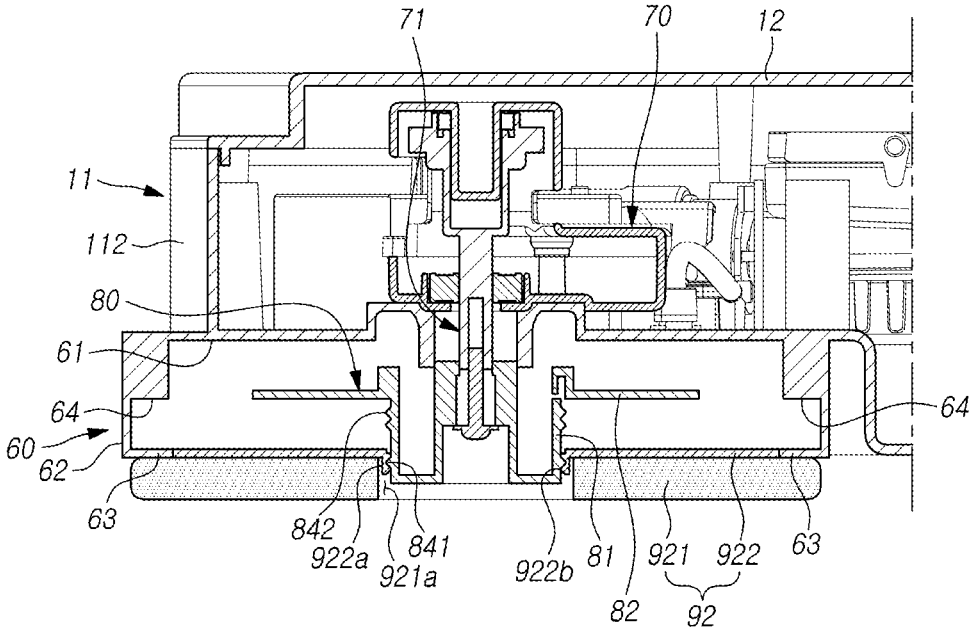

FIGS. 13 and 14 are diagrams for illustrating an operation of a robot cleaner according to an embodiment of the disclosure.

The cleaning driver 70, the rotation member 80, and the cleaning member 90 illustrated in FIGS. 13 and 14 may be substantially the same as or similar to the cleaning driver 70, the rotation member 80, or the cleaning member 90 described above with reference to FIGS. 6 to 12. Accordingly, redundant descriptions for the same configuration will be omitted below.

According to an embodiment, as illustrated in FIG. 13, the rotation member 80 may move upward. The rotation member 80 may move vertically upward from the bottom surface, for example. When the rotation member 80 moves upward, an upward moving force may also be applied to the first cleaning member 91 and the second cleaning member 92 coupled to the rotation member 80.

According to an embodiment, when the rotation member 80 moves upward, the upward movement of the second cleaning member 90 may be partially limited. According to an embodiment, the accommodating case 60 may include a locking jaw 64 for limiting the upward movement of the second cleaning member 92. The locking jaw 64 may be, for example, provided in an upper part in the internal space of the accommodating case 60. The locking jaw 64 may have, for example, a structure protruding inward from an uppermost part of the side surface of the accommodating case 60. The locking jaw 64 may limit the second cleaning member 92 from moving upward along with the rotation member 80, for example, when the rotation member 80 moves upward. The second cleaning member 92 may be released from the coupling with the second sub-coupling 842 positioned in the second part 84*b*, for example, by limitation of the upward movement. After the second cleaning member 92 is detached from the second sub-coupling 842, it may be coupled to the first sub-coupling 841 located in the first part 84*a*.

According to an embodiment, when the rotation member 80 moves upward, the upward movement of the first cleaning member 91 may be partially limited. According to an embodiment, the locking rib 63 of the accommodating case 60 may restrict the first cleaning member 91 from moving upward together with the rotation member 80. According to an embodiment, the first cleaning member 91 may be restricted from moving upward together with the rotation member 80 by the second cleaning member 92 with its upward movement limited. The first cleaning member 91 may be, for example, released from coupling with the first sub-coupling 841 positioned in the first part 84*a*, with limitation of upward movement. The first cleaning member 91 released from the coupling with the first sub-coupling 841 may be detached from the robot cleaner 1.

According to an embodiment, as shown in FIG. 14, the rotation member 80 may move downward. The rotation member 80 may move downward in the direction toward the floor surface, for example. When the rotation member 80 moves downward, the second cleaning member 92 coupled to the first sub-coupling 841 of the rotation member 80 may also move downward. As such, the second cleaning member 92 may be located at a position where the existing first cleaning member 91 was located. The second cleaning member 92 may move out of the accommodating case 60 by the downward movement of the rotation member 80. That is, the second cleaning member 92 may be located underneath the locking rib 63 of the accommodating case 60. One surface of the second cleaning member 92 that has moved downward together with the rotation member 80 may come into contact with the floor surface.

According to an embodiment, when a contamination level of the first cleaning member 91 cleaning the floor surface reaches a predetermined level, the controller 510 may cause to separate the first cleaning member 91 from the robot cleaner 1 through the operation shown in FIG. 13. The first cleaning member 91 may be separated from a predetermined place. For example, the controller 510 may cause to move the robot cleaner 1 to the predetermined place and then separate the first cleaning member 91. The predetermined place may be, for example, a place designated by a user or a position adjacent to a charging station (not shown), but the disclosure is not limited thereto. The controller 510 may separate the first cleaning member 91 and then, place the second cleaning member 92 adjacent to the floor surface, as in the operation shown in FIG. 14, thereby resuming the cleaning again.

When cleaning a floor surface by the robot cleaner 1, continuously using the already contaminated cleaning member 90, the floor surface may be rather more contaminated. The robot cleaner 1 of the disclosure is provided with a function of automatically replacing the used cleaning member 90 in the course of the cleaning process without any user intervention, thereby making the cleaning of the floor surface more convenient and cleaner. Further, since the robot cleaner 1 of the disclosure can efficiently and conveniently determines when to replace the cleaning member 90 in use, the user's convenience can be further enhanced by reducing the number of times to replace the cleaning member 90 in use, compared to when the user has to replace the same manually for oneself.

Figure 15:
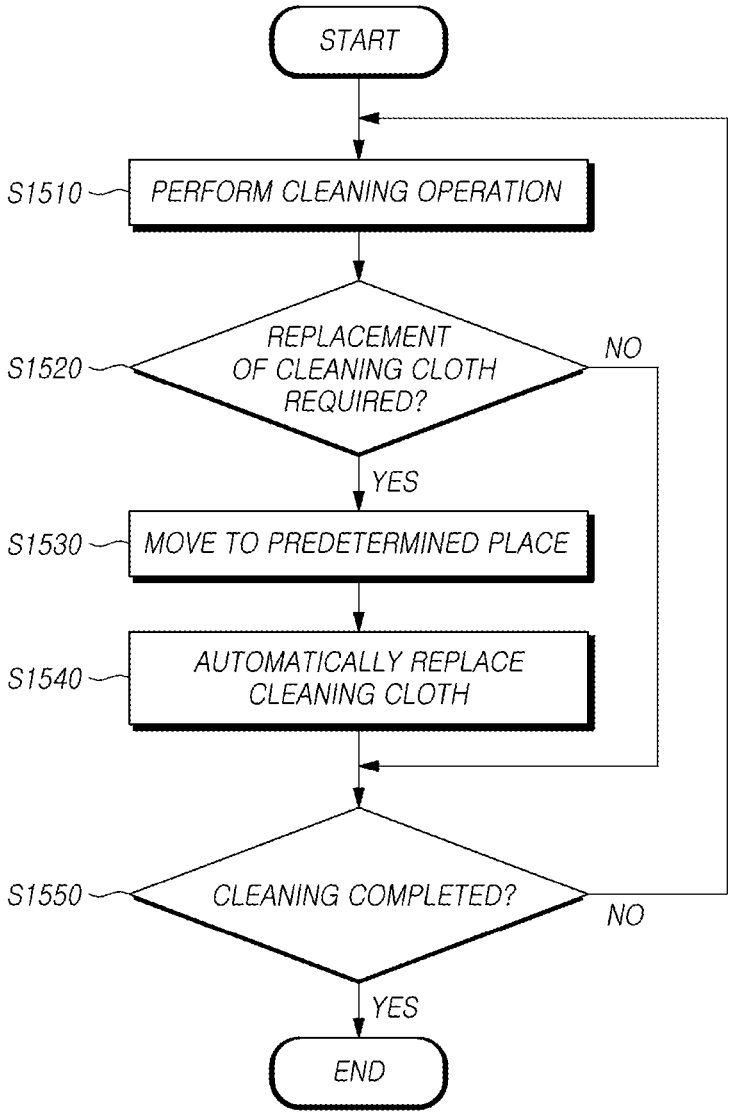
FIG. 15 is a flowchart illustrating a method of operating a robot cleaner according to an embodiment of the disclosure.

FIG. 15 is a flowchart illustrating a method of operating a robot cleaner according to an embodiment of the disclosure.

Hereinafter, according to an embodiment, description will be made of a schematic flowchart of an operation process of the robot cleaner replacing a cleaning member during a cleaning operation. This operation may be performed, for example, by the robot cleaner 1 described above with reference to FIGS. 1 to 14. According to an embodiment, the operation disclosed in FIG. 15 may also be performed by a robot cleaner having some different configurations from the robot cleaner 1 described heretofore.

According to an embodiment, the method of operating the robot cleaner 1 may include performing a cleaning operation (S1510). In an embodiment, while the cleaning operation is in execution, the controller 510 may control the operation of the first motor 571 and/or the second motor 572 to move the robot cleaner 1 along an appropriate driving path. According to an embodiment, the driving path of the robot cleaner 1 may include driving path information stored in the memory 540 and/or route information calculated by the controller 510 according to a result of detection by the sensing unit 520. As an embodiment, while the cleaning operation is in progress, the controller 510 may perform the floor cleaning by controlling the operation of the third motor 581 and/or the fourth motor 582 to rotate the cleaning member 90 positioned adjacent to the floor surface. According to an embodiment, the rotation of the cleaning member 90 for cleaning the floor surface may be performed via the rotating-shaft member 71 and the rotation member 80.

According to an embodiment, the method of operating the robot cleaner 1 may include determining whether a cleaning cloth in current use (e.g., a first cleaning cloth 911) of the cleaning member disposed adjacent to the floor surface should be replaced (S1520). In an embodiment, such a determination may be carried out based on determining whether a degree of contamination for the cleaning cloth in use (e.g., the first cleaning cloth 911) exceeds a certain designated level, using a contamination detection sensor (not shown) that may be separately provided in the robot cleaner 1. In an embodiment, the determination may be carried out by the robot cleaner 1 based on the timer information, for example, determining whether a time duration for which the floor surface cleaning has been executed using the first cleaning cloth 911 exceeds a predetermined reference time. In an embodiment, the robot cleaner 1 may determine whether the cleaning cloth needs to be replaced using a cleaning cloth replacement period preset by the user. For example, in case where the user set the cleaning cloth replacement period to one hour, the robot cleaner 1 may determine that the cleaning cloth needs to be replaced, when it is determined that the hours of use of the first cleaning cloth 911 has just reached one hour.

According to an embodiment, in a case that it is determined that the cleaning cloth needs to be replaced in S1520, the method of operating the robot cleaner 1 may include moving to a predetermined place for replacement of the cleaning cloth (S1530). In an embodiment, the predetermined place may be, for example, a place designated by a user. In an embodiment, the predetermined place may be a place where the robot cleaner 1 performs charging, or any other place adjacent thereto.

According to an embodiment, the method of operating the robot cleaner 1 may include automatically replacing the cleaning member (S1540). According to an embodiment, the robot cleaner 1 may perform an operation of releasing the coupling of the first cleaning cloth 911. In an embodiment, the robot cleaner 1 may perform an operation of moving the rotation member 80 upward under the control of the controller 510. According to an embodiment, while the rotation member 80 moves upward, the first cleaning cloth 911 may be released from the rotation member 80 by a locking structure (e.g., locking rib 63). In an embodiment, the second cleaning cloth 921 may be coupled to the lower end of the rotation member 80, while the rotation member 80 moves upward. For example, a portion to which the existing first cleaning cloth 911 is coupled may move upward in the state of being released from the first cleaning cloth 911, and then coupled to the second cleaning cloth 921. The first cleaning cloth 911 released from the coupling with the rotation member 90 may be detached from the robot cleaner 1 and then placed on the floor surface. The cleaning member replacement process according to an embodiment will be further described with reference to FIG. 16.

According to an embodiment, after the first cleaning cloth 911 is detached from the rotation member 80, the robot cleaner 1 may perform an operation of moving the rotation member 80 downward. The, the second cleaning cloth 921 may be disposed to come into contact with the floor surface by the downward movement of the rotation member 80.

According to an embodiment, the robot cleaner 1 may continuously perform the floor cleaning by replacing the contaminated first cleaning cloth 911 with the new second cleaning cloth 921, through the process of moving the rotation member 80 upward and then downward again under the control of the controller 510.

According to an embodiment, the method of operating the robot cleaner 1 may include determining whether the cleaning is completed (S1550). In an embodiment, the controller 510 may determine whether the cleaning has been completed in a case that the contamination level of the cleaning cloth (e.g., the first cleaning cloth 911 of FIG. 7) is below a predetermined level (S1520). In an embodiment, after completing the operation S1540 of automatically replacing the cleaning member 90, the controller 510 may determine whether the cleaning has been completed. In case controller 510 determines that the cleaning has not yet completed, the controller 510 may return to the operation S1510. After completing a predetermined cleaning schedule, the controller 510 may determine that all the cleaning process has been completed and terminate the operation. According to an embodiment, the process of determining whether the cleaning has been completed may be performed between the respective processes.

Figure 16:
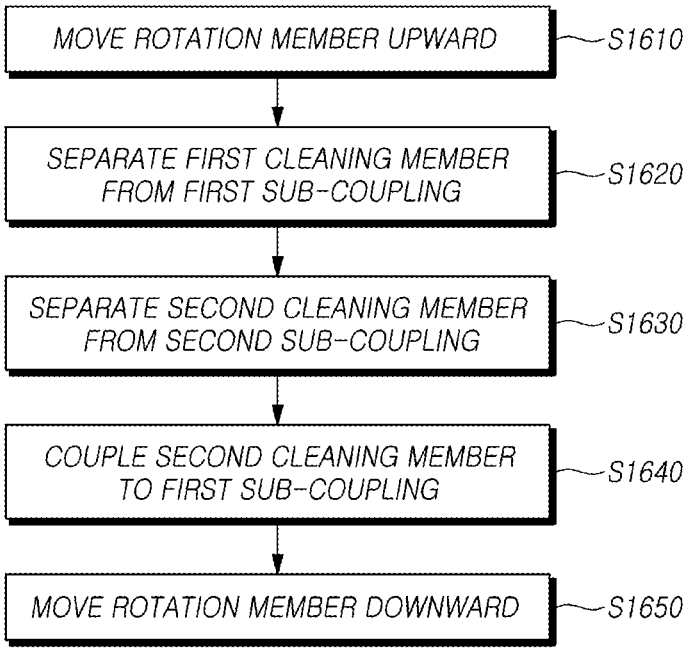
FIG. 16 is a flowchart illustrating a process for replacing a cleaning cloth according to an embodiment of the disclosure.

FIG. 16 is a flowchart illustrating a cleaning cloth replacement process according to an embodiment of the disclosure.

Hereinafter, according to an embodiment, description will be made of a schematic flowchart of an operation process that a robot cleaner automatically replaces a cleaning cloth. This operation may be performed, for example, by the robot cleaner 1 described above with reference to FIGS. 1 to 14. According to an embodiment, the operation disclosed in FIG. 16 may also be performed by a robot cleaner having some different configurations from the robot cleaner 1 described above.

According to an embodiment, the robot cleaner 1 may move the rotation member 80 upward under the control of the controller 510 (S1610). The controller 510 may, for example, control the motor of the cleaning driver 70 to rotate the rotation member 80 in a specific direction (e.g., the first rotation direction ①) to move the rotation member 80 upward, as described with reference to FIGS. 6 to 14.

According to an embodiment, in case the rotation member 80 is moved upward, the first cleaning member 91 may be separated from the first sub-coupling 841 (S1620). Even if the rotation member 80 moves upward, the first cleaning member 91 may be caught by the locking rib 63 of the accommodating case 60, so that the coupling can be released.

According to an embodiment, the second cleaning member 92 may be separated from the second sub-coupling 842 (S1630). Even if the rotation member 80 moves upward, the movement of the second cleaning member 92 may be fixed by the locking jaw 64 provided at an upper side inside the accommodating case 60, so that the coupling can be released from the second sub-coupling 842. The operation process S1630 may be performed substantially simultaneously with the operation process S1620, and the operation process S1630 may be performed before the operation process S1620.

According to an embodiment, the second cleaning member 92 may be coupled to the first sub-coupling 841. The second cleaning member 92 may move to the first part 84*a* of the rotation member 80 by being coupled to the first sub-coupling 841.

According to an embodiment, the robot cleaner 1 may move the rotation member 80 downward under the control of the controller 510 (S1650). The controller 510 may move the rotation member 80 downward, for example, by rotating the rotation member 80 in a direction (e.g., the second rotation direction ②) opposite to the specific direction (e.g., the first rotation direction ①) described above. The second cleaning member 92 may also move downward along the rotation member 80 downwardly moved. The second cleaning member 92 that has moved downward may be in contact with the floor surface. The second cleaning member 92 that has moved downward may be located outside the accommodating case 60.

Figure 17:
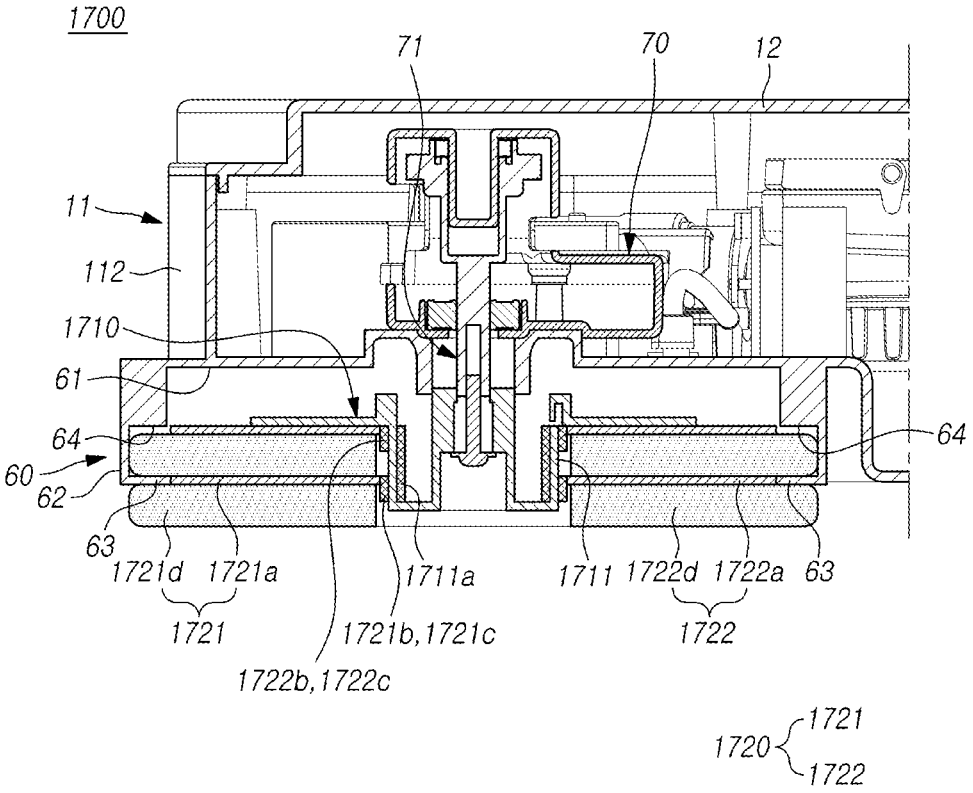
FIGS. 17 to 19 each are diagrams for explaining a configuration of a robot cleaner according to an embodiment.
Figure 18:
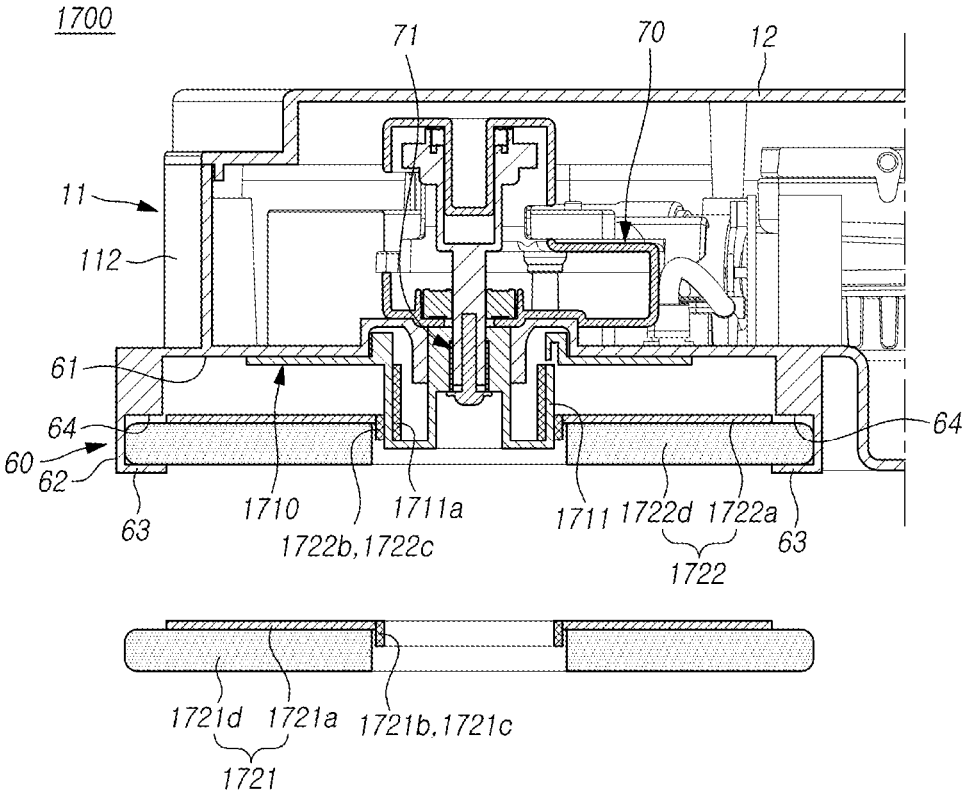
Figure 19:
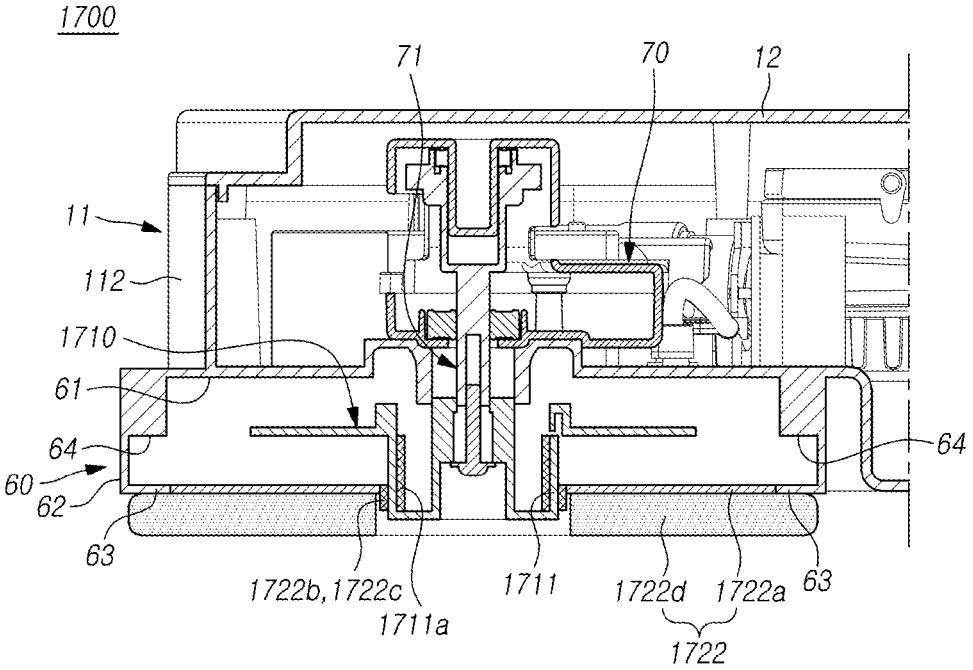

FIGS. 17 to 19 are diagrams for explaining the configuration of a robot cleaner according to an embodiment.

The robot cleaner 1700 shown in FIG. 17 may have substantially the same or similar configuration as the robot cleaner 1 described above with reference to FIG. 7, except for that related to a coupling method between the rotation member and the cleaning member coupling. Therefore, in FIG. 17, the same or like reference numerals as those in FIG. 7 are used for the same or like components as shown in FIG. 7, and their redundant detailed descriptions will be omitted.

According to an embodiment, a rotation member 1710 may include a cleaning member coupling 1711*a*. In an embodiment, at least a portion of the cleaning member coupling 1711*a* may be a magnetic material. In an embodiment, the cleaning member coupling 1711*a* may be provided inside the rotation member 1710, but the disclosure is not limited thereto. In an embodiment, the cleaning member coupling 1711*a* may form a portion of a surface of a central portion 1711 of the rotation member 1710. According to an embodiment, one cleaning member coupling 1711*a* may be coupled to a first coupling 1721*c* or a second coupling 1722*c* of each of two or more cleaning members 1720. Alternatively, for example, a plurality of cleaning member coupling units 1711*a* may be provided within the rotation member 1710 to be coupled to the couplings 1721*c* and 1722*c* of a respective corresponding cleaning member.

According to an embodiment, the cleaning member 1720 may include a first cleaning member 1721 or a second cleaning member 1722. According to an embodiment, the first cleaning member 1721 may include a first coupling 1721*c*. In an embodiment, at least a portion of the first coupling 1721*c* may be a magnetic material. In an embodiment, the first coupling 1721*c* may be provided on a first rib 1721*b* of a first support plate 1721*a*. The first coupling 1721*c* may be magnetically coupled to the cleaning member coupling 1711*a*, for example.

According to an embodiment, the second cleaning member 1722 may include a second coupling 1722*c*. In an embodiment, at least a portion of the second coupling 1722*c* may be a magnetic material. In an embodiment, the second coupling 1722*c* may be provided on a second rib 1722*b* of a second support plate 1722*a*. The second coupling 1722*c* may be magnetically coupled to the cleaning member coupling 1711*a*, for example.

According to an embodiment, when the rotation member 1710 moves upward, the upward movement of the first cleaning member 1721 may be partially limited. According to an embodiment, the locking rib 63 of the accommodating case 60 may restrict the first cleaning member 1721 from moving upward together with the rotation member 80. The first cleaning member 1721 may be, for example, released from coupling with the cleaning member coupling 1711*a*, by restriction of the upward movement. The first cleaning member 1721 of which the coupling with the cleaning member coupling 1711*a* has been released may be separated from the robot cleaner 1700.

According to an embodiment, the rotation member 1710 may move upward. When the rotation member 1710 moves upward, the upward movement of the second cleaning member 1722 may be partially limited by the locking jaw 64 of the accommodating case 60. The second cleaning member 1722 of which movement is partially limited may move to a position before the first cleaning member 1721 is separated.

According to an embodiment, the rotation member 1710 may move downward. The rotation member 1710 may move downward in the direction toward the floor surface, for example. When the rotation member 1710 moves downward, the second cleaning member 1722 coupled to a lower end of the rotation member 1710 may also move downward together. As such, the second cleaning member 1722 may be located at the place where the existing first cleaning member 1721 was located. The second cleaning member 1722 may move to the outside of the accommodating case 60 by the downward movement of the rotation member 1710. That is to say, the second cleaning member 1722 may be located underneath the locking rib 63 of the accommodating case 60. One surface of the second cleaning member 1722 that moved downward together with the rotation member 1710 may come into contact with the floor surface.

Throughout the disclosure and its related drawings, the robot cleaner has been illustrated and described on the basis of the arrangement that it has a pair of cleaning drivers, a pair of rotating-shaft members corresponding thereto, a pair of accommodating cases, and a pair of rotation members, but the disclosure is not limited thereto. In an embodiment, the robot cleaner may include a larger number of cleaning drivers, rotating-shaft members corresponding thereto, accommodating cases, and/or rotation members. In an embodiment, the robot cleaner may include a smaller number of cleaning drivers, rotating-shaft members corresponding thereto, accommodating cases, and/or rotation members.

Although the foregoing disclosure mainly describes an arrangement in which two cleaning members are coupled to each rotation member, the disclosure is not limited thereto. In an embodiment, a larger number of cleaning members may be coupled to each rotation member of the robot cleaner.

The terms used in the disclosure are used only to describe specific embodiments and are not intended to limit the disclosure thereto. For example, a component expressed in a singular form should be understood as a concept including multiple components unless the context explicitly dictates only such a singular form. As used herein, each of the phrases such as "A or B", "at least one of A and B", "at least one of A or B", "A, B or C", "at least one of A, B and C", and "at least one of A, B, or C" may include any one of the items enumerated together in a corresponding one of the phrases, or all possible combinations thereof. Further, it should be appreciated that the term 'and/or' used herein encompasses any and all possible combinations of one or more of the listed items. The terms such as "comprise(s)", "include(s)" "have/has", and "consist(s) of" used in the disclosure are only intended to designate that there are features, components, parts, or a combination thereof described in the disclosure, and are not intended to exclude a possibility of the presence or addition of one or more other features, components, parts, or a combination thereof, by using these terms. The terms such as "the first", "the second", or "first", or "second" may be used simply to distinguish a corresponding component from another corresponding component, and do not limit the corresponding components in view of other aspect (e.g., importance or order).

As used in the disclosure, the expression 'configured to ~' may be used interchangeably with, depending on the context, for example, 'suitable for ~', 'having the ability to ~', 'designed to ~', 'modified to ~', 'made to ~', 'capable of ~' or the like. The term 'configured to ~' may not necessarily mean only 'specially designed to ~' in hardware. Instead, in some situations, the expression 'a device configured to ~' may mean that the device is 'capable of ~' together with another device or component. For example, a phrase 'a device configured to perform A, B, and C' may imply a dedicated device for performing a corresponding operation or imply a general-purpose device capable of performing various operations including the corresponding operation.

Meanwhile, the terms 'upper', 'lower', and 'forward/backward direction' used in the disclosure are defined on the basis of the drawings, and the shapes and positions of each component are not limited by these terms.

Although the foregoing description in the disclosure has been made on the basis of specific embodiments, the disclosure is not limited to such specific embodiments, and it should be understood that it encompasses any and all various modifications, equivalents, and/or substitutes of various embodiments.

What is claimed is:

1. A robot cleaner comprising:

a motor;

a rotating-shaft member; and a rotation member coupled to the rotating-shaft member and including a cleaning member coupling configured to be detachably coupled to a first cleaning member and a second cleaning member such that, when the cleaning member coupling is detachably coupled to the first cleaning member and the second cleaning member, the first cleaning member is at a first position at which the first cleaning member is in position to contact a surface to be cleaned by the robot cleaner and the second cleaning member is at a second position stacked above the first position, wherein the motor, the rotating-shaft member, and the rotation member are configured such that, when the cleaning member coupling is detachably coupled to the first cleaning member and the second cleaning member, the motor is drivable to rotate the rotating-shaft member in a first rotation direction and thereby cause the rotation member to rotate in the first rotation direction and move in a first direction along a longitudinal direction of the rotating-shaft member, such that the first cleaning member becomes detached from the cleaning member coupling, and after the first cleaning member is detached from the cleaning member coupling, the motor is drivable to rotate the rotating-shaft member in a second rotation direction, opposite the first direction, and thereby cause the rotation member to rotate in the second rotation direction and move in a second direction, opposite to the first direction, along the longitudinal direction of the rotating-shaft member, such that the second cleaning member moves to the first position.

2. The robot cleaner according to claim 1, wherein the cleaning member coupling, the first cleaning member, and the second cleaning member each include one or more magnetic bodies configured such that the cleaning member coupling is magnetically coupleable to the first cleaning member and the second cleaning member.

3. The robot cleaner according to claim 1, wherein the first cleaning member includes a first uneven (concavoconvex) coupling structure, the second cleaning member includes a second uneven (concavoconvex) coupling structure, and the cleaning member coupling includes a first protrusion coupleable to the first uneven (concavoconvex) coupling structure and a second protrusion coupleable to the second uneven (concavoconvex) coupling structure.

4. The robot cleaner according to claim 1, further comprising:

an accommodating case including an upper surface disposed above the rotation member along the first direction and a second locking part configured to engage and couple with a first locking part of the rotation member as the rotation member rotates in the first rotation direction, and to be released from being coupled to the first locking part as the rotation member rotates in the second rotation direction.

5. The robot cleaner according to claim 4, wherein the accommodating case includes:

a side surface that, together with the upper surface, defines an internal space for accommodating the second cleaning member, and a locking rib extending parallel to the upper surface from a lower end of the side surface.

6. The robot cleaner according to claim 5, wherein when the cleaning member coupling is detachably coupled to the first cleaning member and the second cleaning member, the second cleaning member is accommodated in the internal space and the first cleaning member is outside the internal space, the detaching of first cleaning member from the cleaning member coupling is at least partially by resistance of the locking rib, and when the rotation member moves in the second direction, the second cleaning member moves out of the internal space and remains coupled to the cleaning member coupling.

7. The robot cleaner according to claim 4, wherein the first locking part and the second locking part have inclined structures corresponding to each other, coupling of the first locking part and the second locking part is performed by coupling in between the inclined structures, and with the first locking part and the second locking part coupled together, the rotation member is movable in the first direction.

8. The robot cleaner according to claim 4, wherein the first locking part includes:

a first opening through which a part of the second locking part is insertable, and a first inclined part adjacent to the first opening to guide insertion of the part of the second locking part.

9. The robot cleaner according to claim 8, wherein the first inclined part is inclined downward in a direction in which the part of the second locking part is inserted.

10. The robot cleaner according to claim 8, wherein the second locking part includes:

a second opening through which a part of the first locking part is insertable, and a second inclined part adjacent to the second opening to guide the insertion of the part of the first locking part.

11. The robot cleaner according to claim 10, wherein the second inclined part is inclined upward in a direction in which the part of the first locking part is inserted.

12. The robot cleaner according to claim 4, wherein as the rotation member rotates in the first rotation direction, the first locking part and the second locking part couple with each other.

13. The robot cleaner according to claim 12, wherein as the rotation member rotates in the second rotation direction, the coupling of the first locking part and the second locking part is released.

14. A method of controlling an operation of a robot cleaner, the robot cleaner comprising:

a motor;

a rotating-shaft member; and a rotation member coupled to the rotating-shaft member and including a cleaning member coupling configured to be detachably coupled to a first cleaning member and a second cleaning member such that, when the cleaning member coupling is detachably coupled to the first cleaning member and the second cleaning member, the first cleaning member is at a first position at which the first cleaning member is in position to contact a surface to be cleaned by the robot cleaner and the second cleaning member is at a second position stacked above the first position, wherein the motor, the rotating-shaft member, and the rotation member are configured such that, when the cleaning member coupling is detachably coupled to the first cleaning member and the second cleaning member, the motor is drivable to rotate the rotating-shaft member in a first rotation direction and thereby cause the rotation member to rotate in the first rotation direction and move in a first direction along a longitudinal direction of the rotating-shaft member, such that the first cleaning member becomes detached from the cleaning member coupling, and after the first cleaning member is detached from the cleaning member coupling, the motor is drivable to rotate the rotating-shaft member in a second rotation direction, opposite the first direction, and thereby cause the rotation member to rotate in the second rotation direction and move in a second direction, opposite to the first direction, along the longitudinal direction of the rotating-shaft member, such that the second cleaning member moves to the first position, the method comprising:

with the cleaning member coupling detachably coupled to the first cleaning member and the second cleaning member, determining whether the first cleaning member is required to be replaced;

based on determining that the first cleaning member is required to be replaced, driving the motor such that the rotation member rotates in the first rotation direction and moves in the first direction, and the first cleaning member thereby becomes detached from the cleaning member coupling; and after the first cleaning member is detached from the cleaning member coupling, driving the motor to such that the rotation member rotates in the second rotation direction and moves in the second direction, and the second cleaning member thereby moves to the first position.

15. The method according to claim 14, wherein the determining whether the first cleaning member is required to be replaced is determined based on whether a time duration for which cleaning of a floor surface using the first cleaning member is performed exceeds a reference time.

16. The method according to claim 14, further comprising:

controlling the robot cleaner to travel to a predetermined position, based on determining that the first cleaning member is required to be replaced.

17. A robot cleaner comprising:

a motor;

a rotating-shaft member; and a rotation member coupled to the rotating-shaft member and including a cleaning member coupling configured to be detachably coupled to a plurality of cleaning members, wherein the motor, the rotating-shaft member, and the rotation member are configured such that the motor is drivable to rotate the rotating-shaft member and thereby cause the rotation member to move in a first direction or a second direction opposite to the first direction, along a longitudinal direction of the rotating-shaft member, and such that, in a case that the rotation member moves in the first direction, at least one cleaning member of the plurality of cleaning members becomes detached, and is thereby released, from the cleaning member coupling, wherein the cleaning member coupling and the plurality of cleaning members each include one or more magnetic bodies configured such that the cleaning member coupling is magnetically coupleable to each of the plurality of cleaning members.

18. A robot cleaner comprising:

a motor;

a rotating-shaft member; and a rotation member coupled to the rotating-shaft member and including a cleaning member coupling configured to be detachably coupled to a plurality of cleaning members, wherein the motor, the rotating-shaft member, and the rotation member are configured such that the motor is drivable to rotate the rotating-shaft member and thereby cause the rotation member to move in a first direction or a second direction opposite to the first direction, along a longitudinal direction of the rotating-shaft member, and such that, in a case that the rotation member moves in the first direction, at least one cleaning member of the plurality of cleaning members becomes detached, and is thereby released, from the cleaning member coupling, wherein the plurality of cleaning members include a plurality of uneven (concavoconvex) coupling structures, respectively, and the cleaning member coupling includes a plurality of protrusions coupleable to the plurality of cleaning members by engaging with the plurality of uneven (concavoconvex) coupling structures, respectively.

* * * * *